US012281526B2

(12) United States Patent
Younger et al.

(10) Patent No.: US 12,281,526 B2
(45) Date of Patent: Apr. 22, 2025

(54) METHOD AND SYSTEM FOR SUSPENDING A DRILL STRING AND ISOLATING A WELLBORE

(71) Applicant: SAUDI ARABIAN OIL COMPANY, Dhahran (SA)

(72) Inventors: Rae Younger, Aberdeenshire (GB); Richard Mark Pye, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/359,638

(22) Filed: Jul. 26, 2023

(65) Prior Publication Data

US 2025/0034960 A1 Jan. 30, 2025

(51) Int. Cl.
*E21B 23/02* (2006.01)
*E21B 33/134* (2006.01)

(52) U.S. Cl.
CPC ..... *E21B 23/02* (2013.01); *E21B 33/134* (2013.01)

(58) Field of Classification Search
CPC ..... E21B 33/12; E21B 40/001
See application file for complete search history.

(56) References Cited

U.S. PATENT DOCUMENTS 4,007,783 A 2/1977 Amancharla et al.
4,044,827 A 8/1977 Kerzee et al.
4,178,992 A 12/1979 Regan et al.
7,290,603 B2 11/2007 Hiorth et al.
10,563,471 B2 2/2020 Georgsen et al.
10,648,323 B2 5/2020 Hughes et al.
11,149,516 B2 * 10/2021 Machocki ..... E21B 33/1294
11,365,606 B2 6/2022 Andreychuk et al.
2004/0069496 A1 * 4/2004 Hosie ..... E21B 33/1275 166/373
2011/0036564 A1 * 2/2011 Williamson ..... E21B 33/134 166/301
2018/0135370 A1 5/2018 Yang et al.
2019/0128074 A1 * 5/2019 Stokes ..... E21B 33/12
2020/0088001 A1 3/2020 Morland
2020/0347693 A1 11/2020 Wood et al.

OTHER PUBLICATIONS http://www.midlandoiltools.com/packers.html, accessed on Jul. 26, 2023 (14 pages).

(Continued)

*Primary Examiner* — Tara Schimpf
*Assistant Examiner* — Ursula Lee Norris
(74) *Attorney, Agent, or Firm* — Osha Bergman Watanabe & Burton LLP

(57) ABSTRACT

A system including a plug with a first end connected to a lower drill string and a second end connected to an upper drill string. The plug further includes a sealing element configured to seal against a reservoir pressure that is downhole from the plug, and an anchoring element configured to releasably couple the plug to a wellbore to disallow an axial movement of the plug in the wellbore. The plug is configured to couple to a retrieving tool. The retrieving tool includes a first engagement element configured to release the anchoring element, thereby allowing axial movement of the plug and retrieval of the upper drill string in order to shut in the wellbore.

20 Claims, 17 Drawing Sheets

(56) References Cited

OTHER PUBLICATIONS https://www.expro.com/products/brute-retrievable-service-packer, accessed on Jul. 26, 2023 (5 pages).
https://www.halliburton.com/en/completions/wellbore-service-tools/service-packers, accessed on Jul. 26, 2023 (6 pages).
International Search Report issued for corresponding international patent application No. PCT/US2024/038460, mailed Oct. 24, 2024 (6 pages).
Written Opinion issued for corresponding international patent application No. PCT/US2024/038460, mailed Oct. 24, 2024 (9 pages).

* cited by examiner

METHOD AND SYSTEM FOR SUSPENDING A DRILL STRING AND ISOLATING A WELLBORE

BACKGROUND

Hydrocarbon resources are typically located below the surface of the earth in subterranean porous rock formations, often called reservoirs. These hydrocarbon-bearing reservoirs can be found in depths of tens of thousands of feet below the surface. In order to extract the hydrocarbon fluids, also referred to as oil and/or gas, wells may be drilled to gain access to the reservoirs. Hydrocarbons may flow from the subsurface hydrocarbon reservoirs under pressure, therefore the pressure must be controlled both during the drilling and afterward during production. If during the course of drilling the well drilling operations are to be temporarily discontinued, then the pressure must be retained in the wellbore, but not permanently shut in. This is known in the art as suspending well drilling operations.

Temporary shut in may be performed with the use of a removable seal or packer, as is known in the art. Temporarily suspending the well drilling operations may include leaving the drill string in the wellbore until the time when well drilling operations recommence. Removing the drill string (tripping out of hole as is known in the art) may take many hours. For temporarily suspending well drilling operations it may be advantageous to leave the majority of the drill string in the hole. Therefore, a need arises to run a packer below the blow out preventers to suspend the drill string in the well and seal the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments a plug including a body with a first end connected to a lower drill string and a second end connected to an upper drill string. The body further includes a sealing element configured to seal against a reservoir pressure that is downhole from the plug, and an anchoring element configured to releasably couple the plug to a wellbore to disallow an axial movement of the plug in the wellbore. The plug is configured to couple to a retrieving tool. The retrieving tool includes a first engagement element configured to release the anchoring element, thereby allowing axial movement of the plug and retrieval of the upper drill string in order to shut in the wellbore.

This disclosure presents, in accordance with one or more embodiments a method for abandoning a well. The method includes drilling a wellbore with a drill string including a lower drill string and an upper drill string, pulling the drill string out of the wellbore a predetermined length, and connecting a plug to the lower drill string. The plug includes a sealing element configured to seal a reservoir pressure that is downhole from the plug and an anchoring element configured to releasably couple the plug to the wellbore to disallow an axial movement of the plug in the wellbore. The method includes connecting a retrieving tool to the upper drill string. The retrieving tool includes a first engagement element disposed at a tool first end. The first engagement element is configured to couple to the plug and configured to release the anchoring element thereby allowing the axial movement. The method includes deploying the plug into the wellbore, anchoring the plug in the wellbore using the anchoring element, disengaging the first engagement element from the plug, pulling the upper drill string out of the wellbore, and abandoning the well with the lower drill string in the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
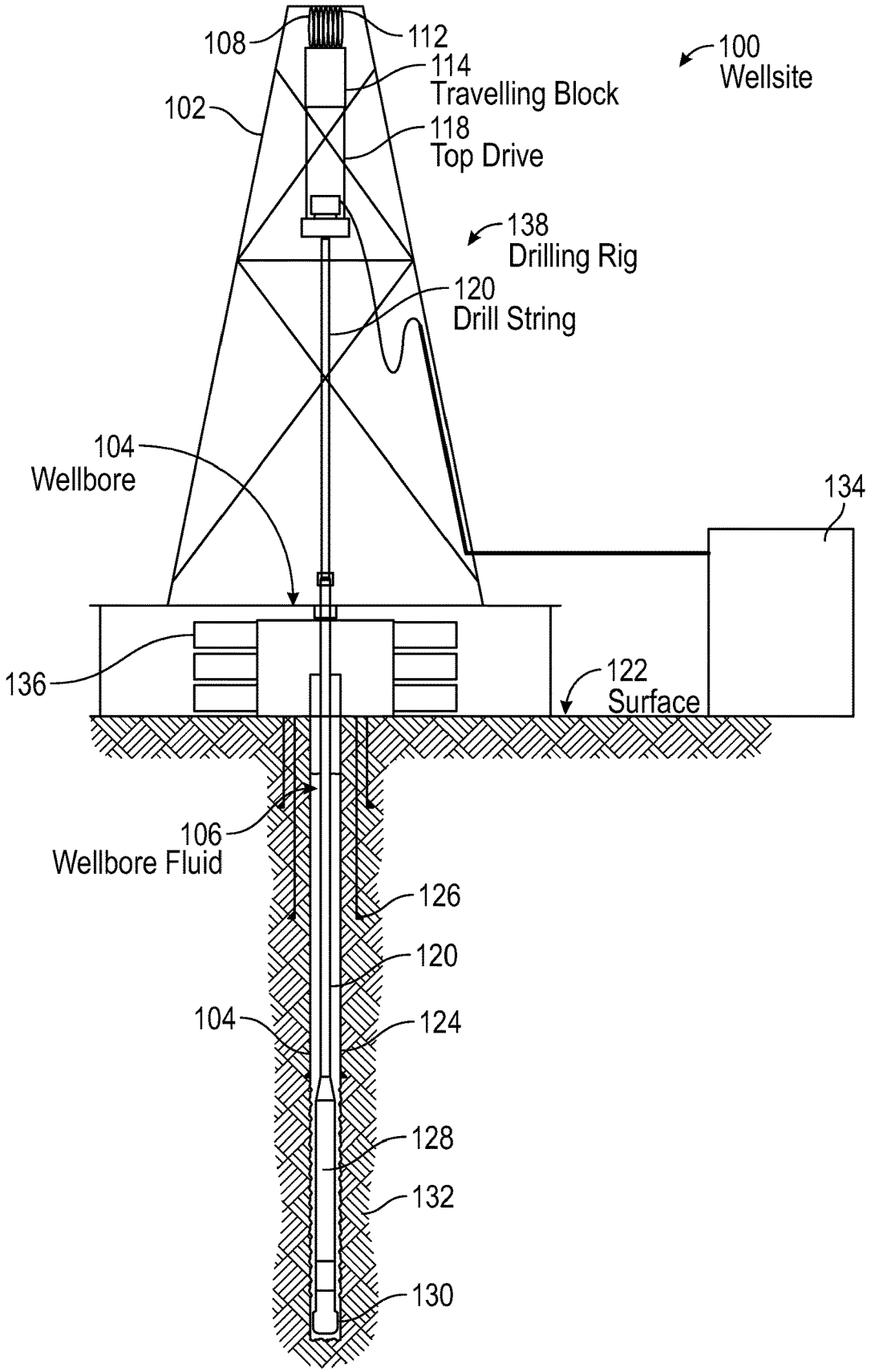
FIG. 1 illustrates an example well site in accordance with one or more embodiments.

In the following detailed description of embodiments of the disclosure numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and may succeed or precede the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

Embodiments disclosed herein relate to a system and method for temporarily abandoning a first portion of a drill string in a wellbore (i.e., a first drill string or a lower drill string portion that is directed downhole in the wellbore) by installing a packer, suspending the first portion of the drill string below the packer, and retrieving a second portion of the drill string. (i.e., a second drill string or an upper drill string portion that is directed uphole in the wellbore). More specifically, embodiments disclosed herein relate to a tool/device for rapidly suspending operations and allowing a well to be shut in. The tool automatically seats in the well without the need for surface manipulation and seals the bore without the need to trip the drill string fully out of the hole. This allows the BOPs to be fully closed and the rig evacuated. The tool/device is may be known by various names such as packer, storm packer, plug, wellbore isolation tool, and emergency wellbore suspension and isolation tool. In one or more embodiments, the tool/device is referred to herein as a plug device or a plug. The plug is installed and removed by a running and retrieving tool, referred to herein as a retrieving tool component or a retrieving tool.

When drilling an oil and gas well from an offshore floating rig or drill ship it is often very hard to maintain safe well drilling operations when the sea states are rough in bad weather. It is often necessary during these times to suspend drilling and move off location until it is safe to resume drilling operations. As tripping out of hole can take many hours it is advantageous to be able to leave the drill string, or a portion of the drill string, in the hole and run a packer below the mud line which suspends the string and seals the wellbore. Blowout preventers (BOPs) may be closed and a riser may be disconnected and the rig moved off location. A storm packer can be used to accomplish temporarily abandoning the well such that the BOPs may be closed and the riser disconnected. The drill string is tripped out to a required depth to pick up a running tool and a packer (e.g., a storm packer) and run back in hole, where the packer is set below the BOPs. A portion of the drill string is hung off below the packer and the wellbore is sealed against fluid influx from below and against sea water from above. The drill string pipe above the packer is released from the packer and pulled out of hole. Packers such as this use slips to engage the casing and hold the string in the well.

The system and method disclosed herein are also applicable to land drilling applications. On land drilling applications, while there is not a need to pull off location due to weather there may be a need to evacuate a rig site at short notice and leave it secure. Such reasons may be an imminent attack by terrorists or an impending environmental event which could threaten the rig or its crew.

In contrast to prior systems in which the entire drill string is tripped out of hole and a bridge plug is separately run and set, which is time consuming and costly, the present disclosure provides a system and method that allows much of the drill string to remain in the well. The system and method of the present disclosure allows the drill string to be hung off below the wellbore isolation tool, allows the wellbore to be sealed, and locks the tool to the casing wall all in one trip, thereby saving time on the order of many hours.

The present application describes and illustrates an emergency well abandonment system which can seal off a wellbore in a very short time thereby leaving the well in a safe condition, optionally with the BOPs fully closed so that the rig personnel can safely evacuate the rig. The system and method disclosed herein has been designed so that it does not require any third-party personnel to install—such as a wireline or coiled tubing unit/crew—and requires no manipulation of weight or rotary action to set in place.

FIG. 1 illustrates an example well site 100. Well sites may be configured in a myriad of ways; therefore, the well site 100 is not intended to be limiting with respect to the particular configuration of the drilling equipment. The well site 100 is depicted as being on land. In other examples, the well site 100 may be offshore, and drilling may be carried out with or without use of a marine riser. A well drilling operation at the well site 100 may include drilling a wellbore 104 with a wellbore fluid 106 from the surface of the earth (e.g., surface 122) into a subsurface including various types of the formation 132. For the purpose of drilling a new section of wellbore 104, a drill string 120 is suspended within the wellbore 104. The drill string 120 may include one or more drill pipes connected to form a conduit and a bottom hole assembly (a BHA 128) disposed at the distal end of the conduit. The BHA 128 may include a drill bit 130 to cut into the subsurface rock. The BHA 128 may include measurement tools, such as a measurement-while-drilling (MWD) tool or a logging-while-drilling (LWD) tool (not shown), as well as other drilling tools that are not specifically shown but would be understood to a person of ordinary skill in the art.

The drill string 120 may be suspended in wellbore 104 by a derrick (e.g., a derrick structure 102). A crown block 112 may be mounted at the top of the derrick structure 102. A traveling block 114 may hang down from the crown block 112 by means of a cable or drill line (e.g., drill line 108). One end of the drill line 108 may be connected to a drawworks, which is a reeling device that can be used to adjust the length of the drill line 108 so that the traveling block 114 may move up or down the derrick structure 102. The top drive 118 is coupled to the top of the drill string 120 and is operable to rotate the drill string 120. Alternatively, the drill string 120 may be rotated by means of a rotary table (not shown) on the surface 122. The drill string is used with a BOP (e.g., blowout preventer 136). The BOP may be used to seal the well. Drilling fluid (commonly called mud) (not shown) may be pumped from a mud system 134 into the drill string 120. The mud may flow into the drill string 120 through appropriate flow paths in the top drive 118, or through a rotary swivel if a rotary table is used (not shown). Details of the mud flow path have been omitted for simplicity, but would be readily understood by a person of ordinary skill in the art.

During a well drilling operation at the well site 100, the drill string 120 is rotated relative to the wellbore 104 and weight is applied to the drill bit 130 to enable the drill bit 130 to break rock as the drill string 120 is rotated. In some cases, the drill bit 130 may be rotated independently with a drilling motor (not shown). In other embodiments, the drill bit 130 may be rotated using a combination of a drilling motor (not shown) and the top drive 118 (or a rotary table if used instead of a top drive) to rotate the drill string 120. While cutting rock with the drill bit 130, mud is pumped into the drill string 120. The mud flows down the drill string 120 and exits into the bottom of the wellbore 104 through nozzles in the drill bit 130. The mud in the wellbore 104 then flows back up to the surface 122 in an annular space between the drill string 120 and the wellbore 104 carrying entrained cuttings to the surface 122. The cuttings are removed and the fluid is returned to the mud system 134 to be recycled and circulated back again into the drill string 120. The components of the drill site may collectively be referred to as a drilling rig 138.

Well drilling operations are completed upon the retrieval of the drill string 120, the BHA 128, and the drill bit 130 from the wellbore 104. In some embodiments of wellbore 104 construction, the production casing operations may commence. Production casing operations includes installing casing in the wellbore. A casing string 124, which is made up of one or more larger diameter tubulars that have a larger inner diameter than the drill string 120 but a smaller outer diameter than the wellbore 104, is lowered into the wellbore 104 on the drill string 120. Generally, the casing string 124 is designed to isolate the internal diameter of the wellbore 104 from the formation 132. Once the casing string 124 is in position, it is set and cement is pumped down through the internal space of the casing string 124, out of the bottom of the casing shoe 126, and into the annular space between the wellbore 104 and the outer diameter of the casing string 124. This secures the casing string 124 in place and creates the desired isolation between the wellbore 104 and the formation 132. At this point, drilling of the next section of the wellbore 104 may commence.

Figure 2A:
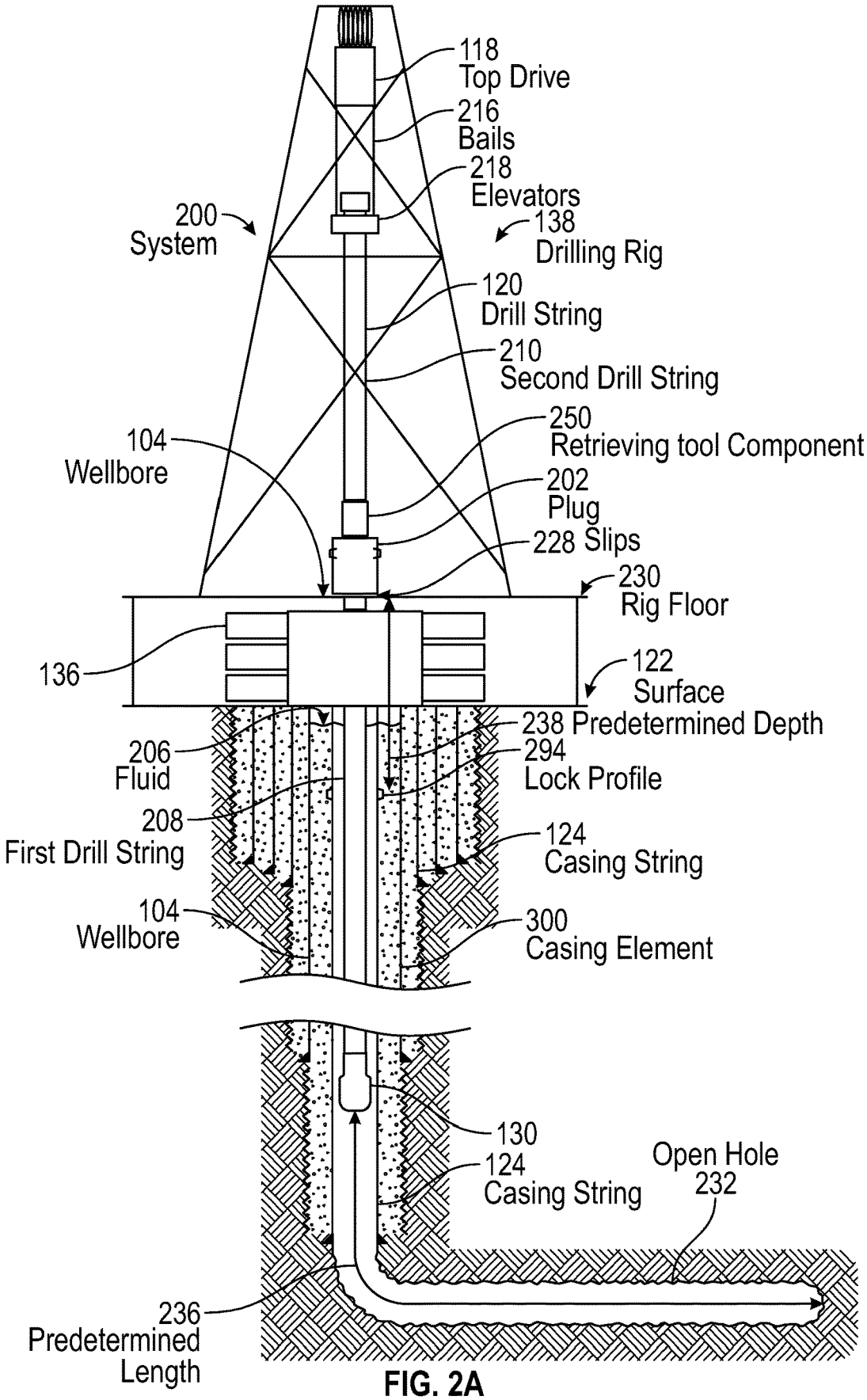
FIG. 2A shows a drill string pulled out of a wellbore a distance using a drilling rig in accordance with one or more embodiments.
Figure 2B:
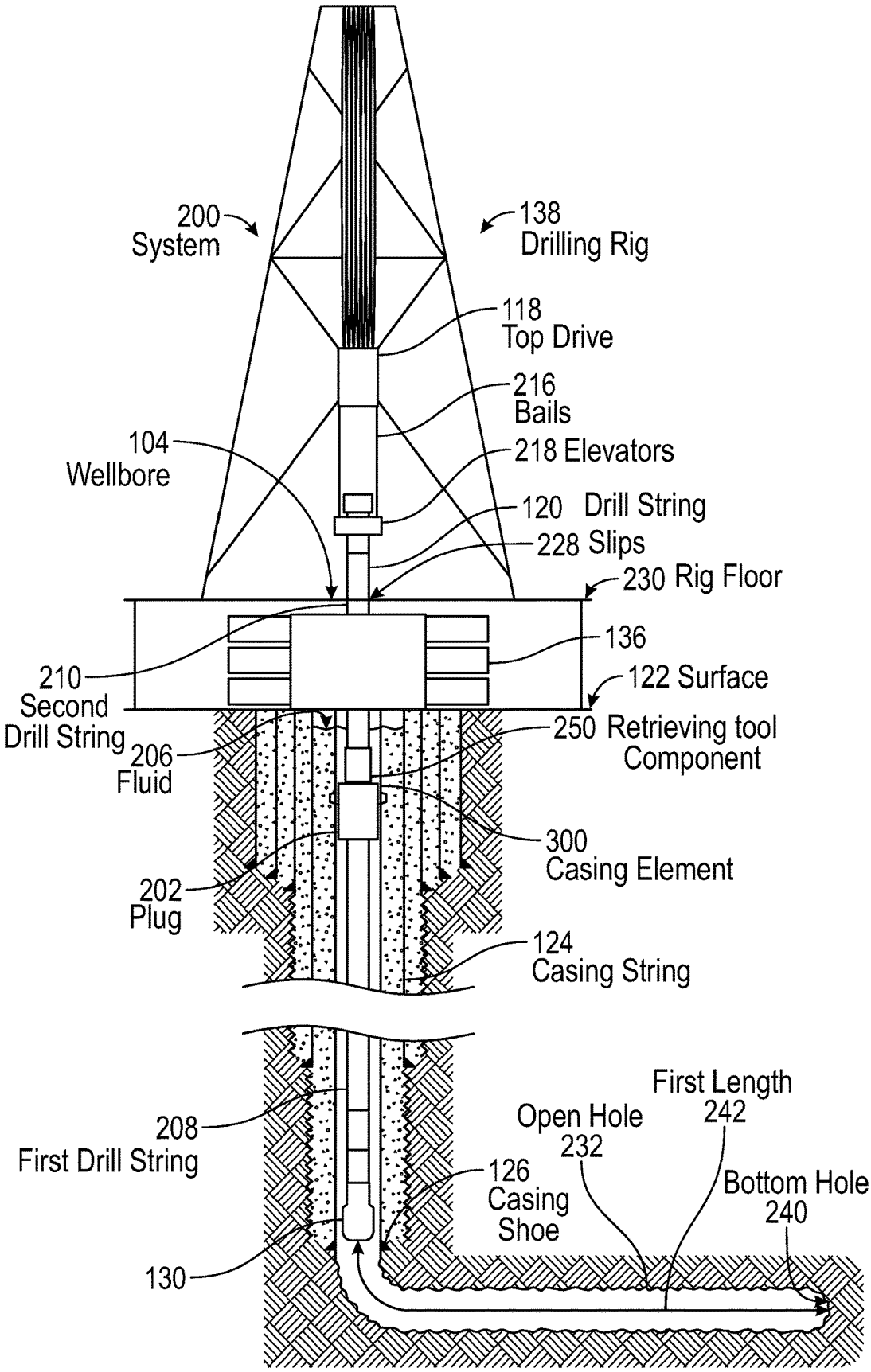
FIG. 2B shows the drill string in the wellbore in accordance with one or more embodiments.
Figure 2C:
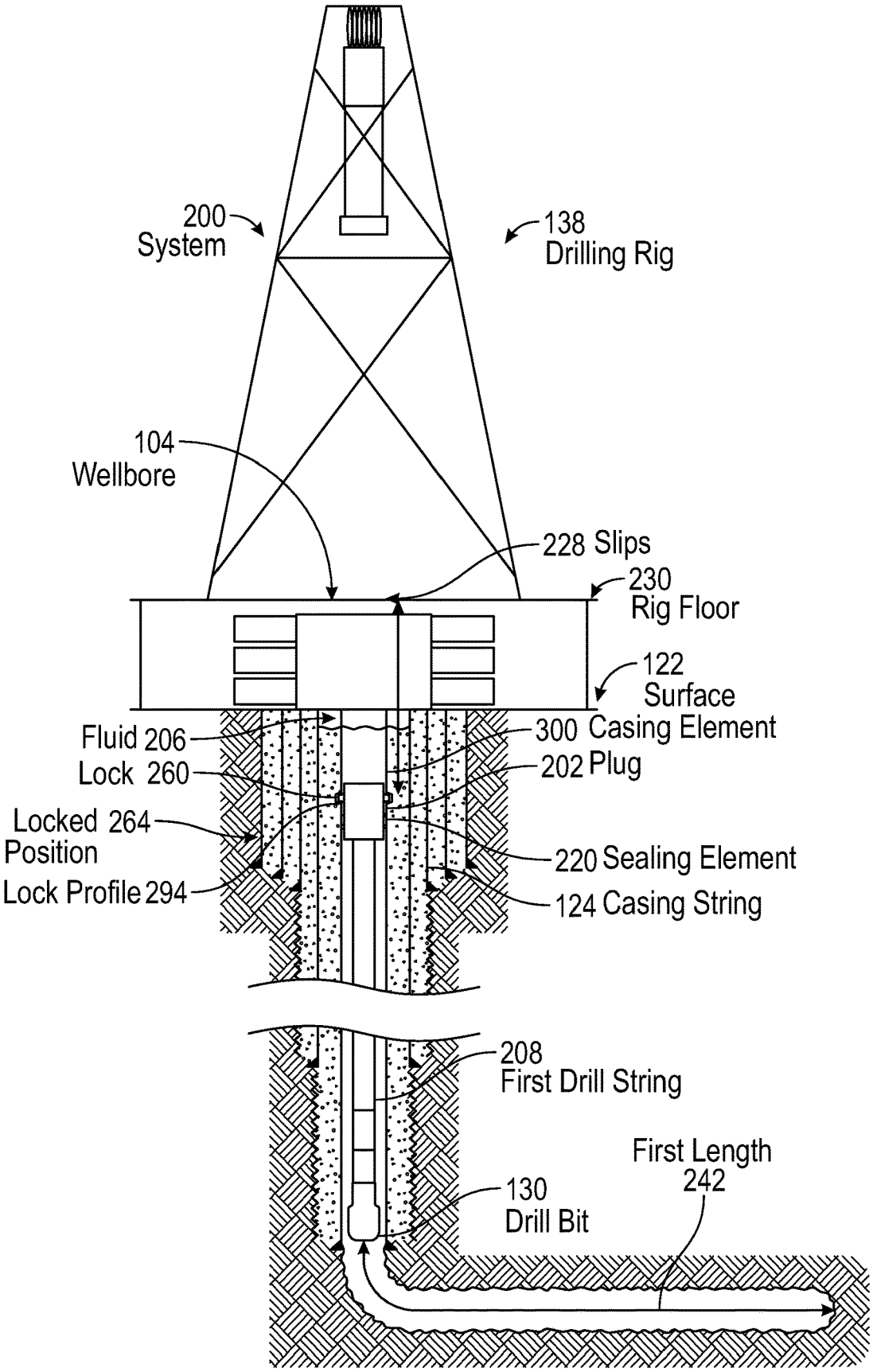
FIG. 2C shows a second drill string and a retrieving tool removed from the wellbore in accordance with one or more embodiments.

FIGS. 2A-2C show an operational sequence of an embodiment of a system 200. The drill string includes a second drill string 210, (i.e., a second portion of a drill string or an upper drill string portion that is directed uphole in the wellbore) coupled to a retrieving tool component. The retrieving tool component may be known by various names such as running tool, running-retrieving tool, J-slot running tool and J-slot tool. The retrieving tool component is referred to herein as a retrieving tool (e.g., a retrieving tool 250). The retrieving tool is located between the second drill string and the wellbore isolation tool (e.g., a plug 202). A first drill string 208 (i.e., a first portion of a drill string or a lower drill string portion that is directed downhole in the wellbore) is connected to the downhole end of the plug. The drill bit 130 is connected to the downhole end of the first drill string. The wellbore 104 is shown with a fluid 206 inside the wellbore. The wellbore also is shown with five casing strings (e.g., the casing string 124) and a casing element 300. The casing element 300 is shown installed within a casing string in the wellbore at a predetermined distance down (e.g., a predetermined depth 238) from a datum on the surface 122 such as a rig floor 230.

FIG. 2A shows the drill string 120 pulled out of the borehole (e.g., wellbore 104) a distance such as a predetermined length 236 using the drilling rig 138, bails 216, and elevators 218. Plug 202 is shown set in slips 228 on the rig floor 230.

FIG. 2B shows the drill string 120 in the wellbore. The plug is shown located within the wellbore at a predetermined depth down from the surface 122. The drill bit 130 is shown to be just uphole from the casing shoe 126. Casing shoe 126 is shown as the uphole end of an open hole 232. The location as shown of the drill bit just inside the casing shoe may represent an optimum predetermined length of pipe removed from the well to install the plug 202. For example, a drilling operation may be in progress with drilling in the open hole 232 and with the drill bit on bottom (e.g., a bottom hole 240). An impending emergency may be determined to result in the need for a suspension of well drilling operations. The impending emergency, such as a forecasted storm or pending terrorist attack, may provide adequate time for using the system 200 to suspend well drilling operations in a controlled manner. Use of the system 200 may include tripping the drill string out of the hole the predetermined length.

An example of a predetermined length may be calculated by adding two measurements, a first length and a second length. The first length measurement is the length from the bottom hole location to the casing shoe location which is calculated as the difference in measured depth of the bottom hole depth and the casing shoe depth. The first length is the length (e.g., a first length 242) represented in FIGS. 2B and 2C by the position of the drill bit having been pulled out of hole from the bottom hole to back inside (uphole from) the last casing shoe (e.g., casing shoe 126). The second length is the predetermined distance down (e.g., the predetermined depth 238) of the casing element 300 from the surface datum. The second length is represented in FIG. 2A by the depth of the lock profile 294.

An example of a predetermined length may be illustrated with values in feet for the various measurements. The following is a predetermined length calculation using the following values: 1) a bottom of the hole at 10,000 ft (feet) (e.g., a bottom hole 240 is a 10,000 feet measured depth); 2) a measured depth of the last casing shoe at 8000 ft; and 3) the casing element 300 is set at a depth of 200 ft. The first length is calculated as 10,000 ft−8000 ft=2000 ft. The second length is 200 ft. The drill pipe will need to be tripped out of the hole a length of 2000 ft+200 ft=2200 ft. E.g., 10000 ft−8000 ft+200 ft=2200 ft. Using the system 200, the majority of the drill pipe (e.g., 10,000 ft−2200 ft=7800 ft) may be left in the hole. Allowing for some margin an extra stand (three joints of pipe equivalent to 90-144 ft depending on drill pipe length) will be removed for a total of 2300 ft.

FIG. 2A shows that the plug 202 may be installed in the drill string between the first drill string and the second drill string. The retrieving tool 250 may be coupled to the second drill string, then the retrieving tool may be picked up and connected to plug 202. FIG. 2B shows that the drill string with the plug is then tripped back in hole until the plug 202 couples with the casing element 300 and locks in place.

FIG. 2C shows that the second drill string 210 and the retrieving tool have been removed from the wellbore. The plug 202 is shown set at the predetermined depth with the first drill string 208 suspended below the plug. The plug is shown with a lock 260. The lock is configured with a locked position 264 in which the lock is moved radially outward from an outside surface of the tool to engage a lock profile 294 located in the casing element 300. In this manner, the blowout preventer 136 may be closed without a drill pipe penetrating through the BOP.

Figure 3:
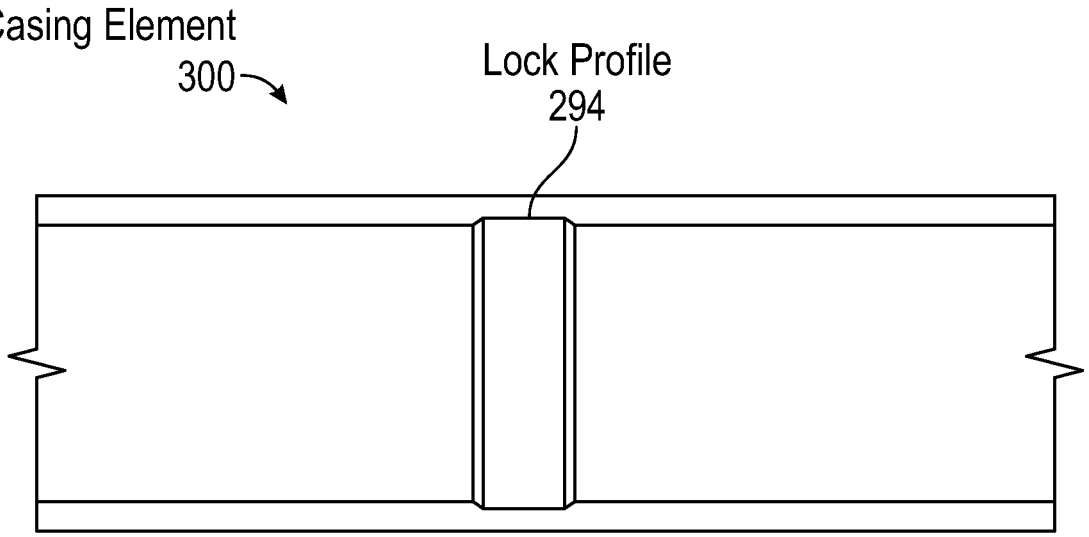
FIG. 3 shows a casing element in accordance with one or more embodiments.

FIG. 3 shows the casing element in accordance with one or more embodiments. The isolation tool (e.g., plug 202) anchors into the wellbore using a slipless action of dogs which locate into recesses (e.g., lock profile 294) in the casing wall (e.g., casing element 300). The casing element comprises a casing joint with a radial groove profile (e.g., lock profile 294) that will accept the tool dogs (e.g., the lock 260) of the plug and support the weight of the drill string (e.g., first drill string 208) below the location of the lock profile. Special joints of casing that include the lock profile may be installed into the well as part of the well construction. For example, the lock profile may be installed as part of the last casing run. The lock profile 294 of the casing element 300 may be installed at a predetermined depth. For example, typical setting depth may be 100-200 ft.

Figure 4:
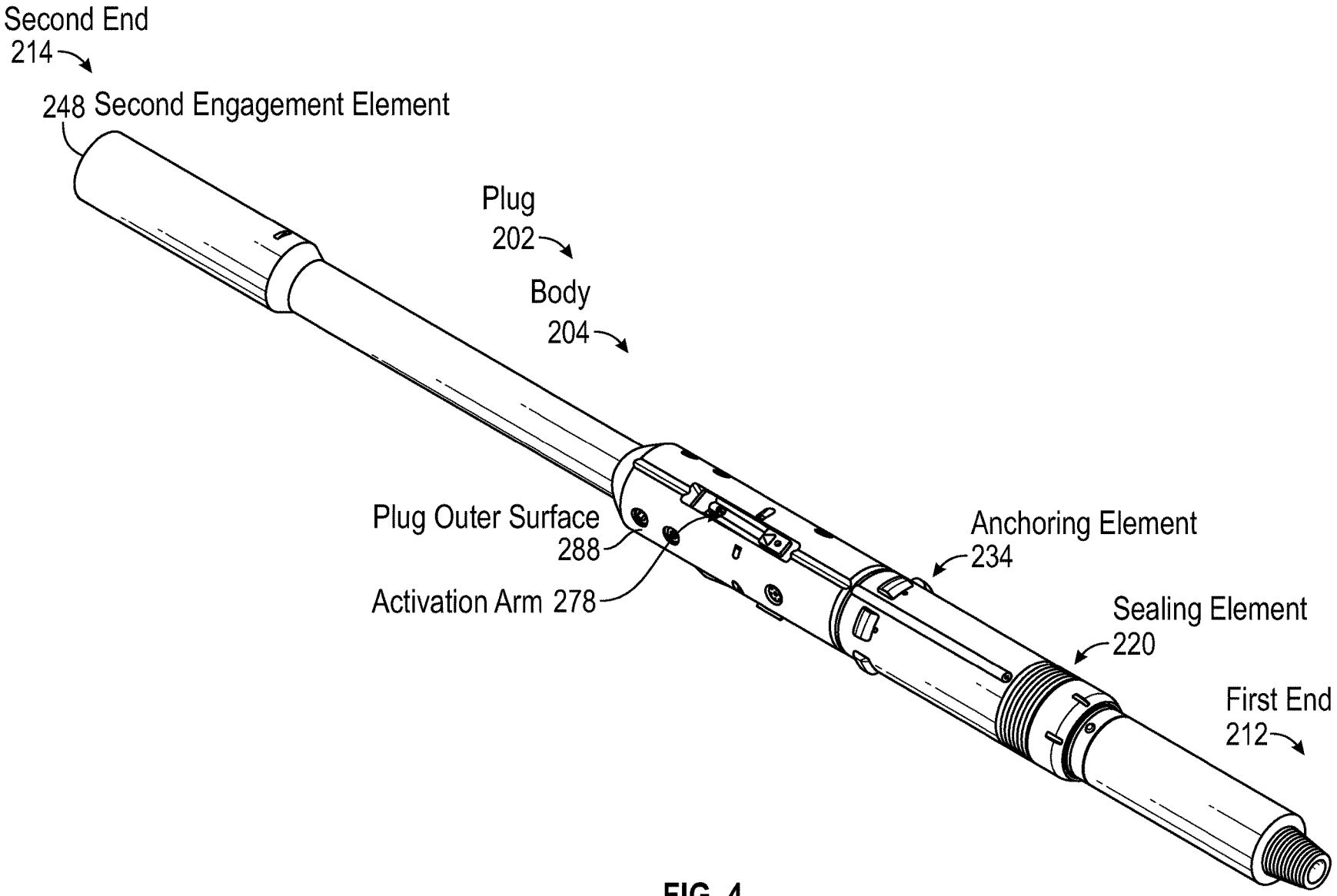
FIGS. 4-8 show a plug in various configurations in accordance with one or more embodiments.

FIGS. 4-7 show the components of the plug in accordance with one or more embodiments. Referring to FIG. 4, the plug 202 has a sealing element 220 located on an outer surface (e.g., plug outer surface 288) of the tool. The plug has an anchor (e.g., an anchoring element 234) located near the outer surface and configured to be selectively extendable outward from the outer surface. The plug has one or more activation arms (e.g., an activation arm 278) configured to retain the anchoring element in the set position and to activate the anchoring element. The plug is configured to couple to a running and retrieving tool at a top prep, (e.g., second engagement element 248). The plug may have a body 204 such as an upper body configured for engaging pipe slips on a rig floor. The pipe slips may suspend the plug at the rig floor. Body 204 has two ends. The first end of body 204 is a downhole end (e.g., a first end 212) and the second end of body 204 is an uphole end (e.g., a second end 214).

Figure 5:
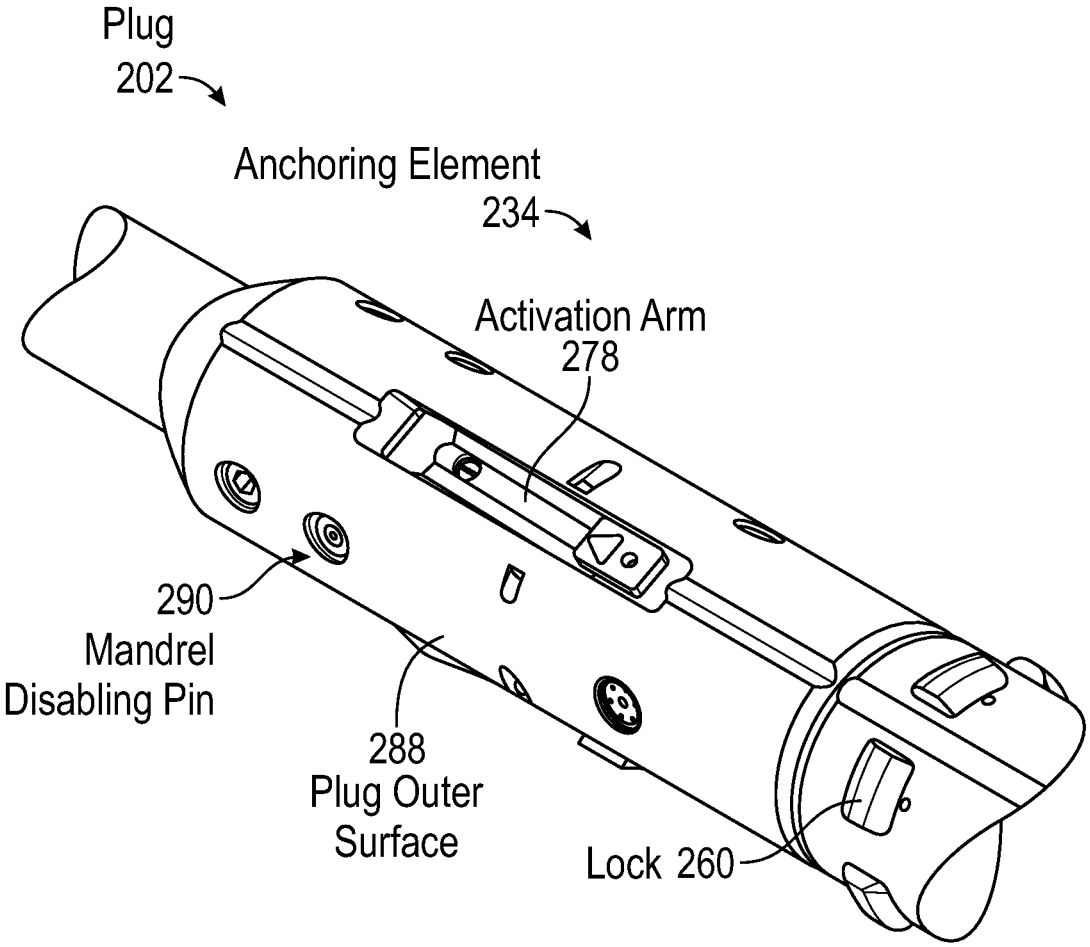

FIG. 5 also shows the plug in accordance with another embodiment disclosed herein. In FIG. 5, the plug has the anchoring element 234 which includes the lock 260 and the activation arm 278. A mandrel disabling pin (e.g., pin 290) is located on the outer surface (e.g., plug outer surface 288).

Figure 6:
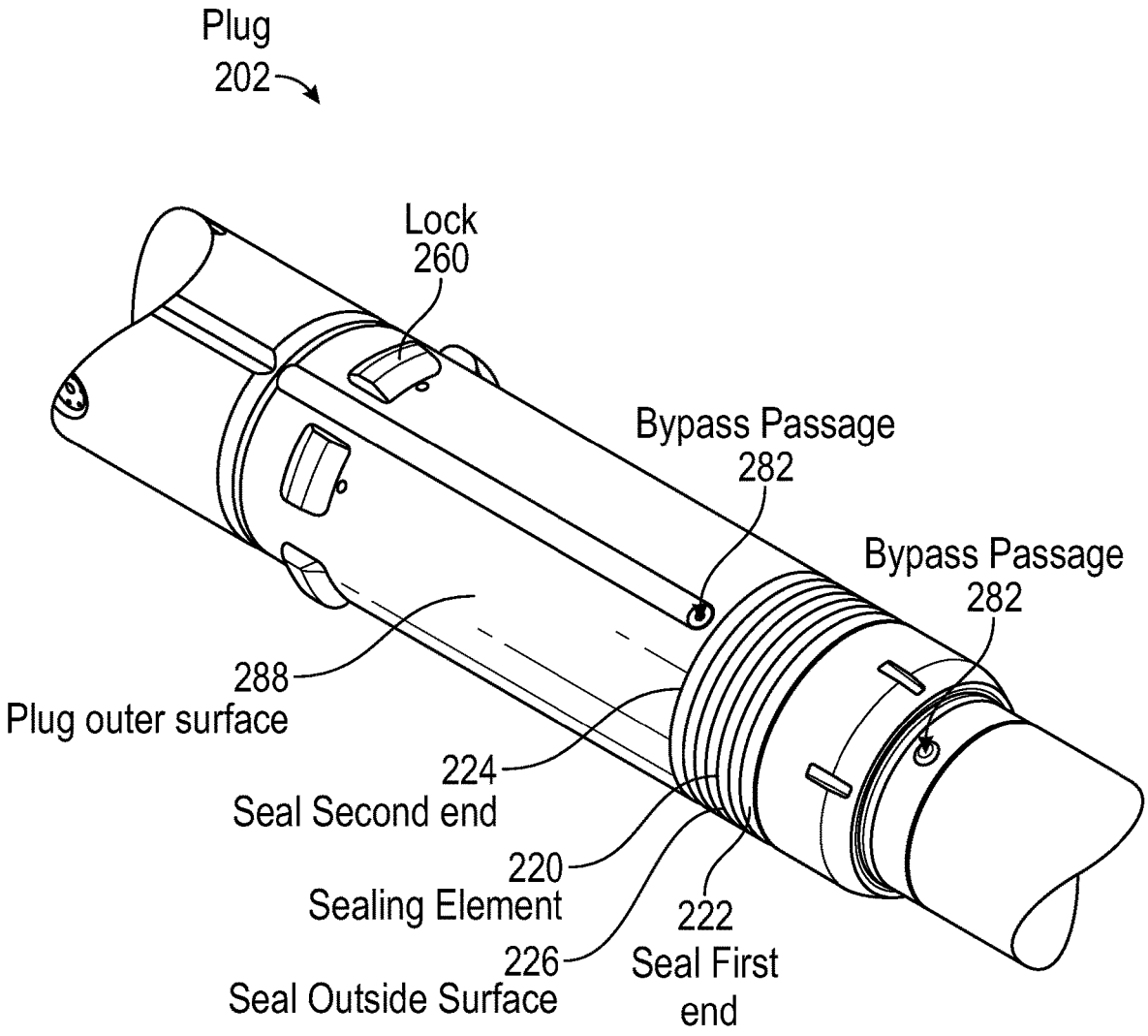

FIG. 6 also shows the plug in accordance with another embodiment disclosed herein. In FIG. 6, the plug 202 has a seal (e.g., the sealing element 220) with a downhole end (e.g., a seal first end 222), an uphole end (e.g., a seal second end 224), and an outside diameter of an outer surface (e.g., a seal outside surface 226). The plug has the lock 260. A pressure equalization port or bypass (e.g., a bypass passage 282) is shown penetrating the tool wall (e.g., plug outer surface 288). Bypass passage 282 may be configured to allow a displaced fluid to bypass the sealing element 220. For example, a displaced fluid caused by running the plug into or out of the wellbore may bypass the seal outside surface 226 by flowing through the bypass passage 282.

Figure 7:
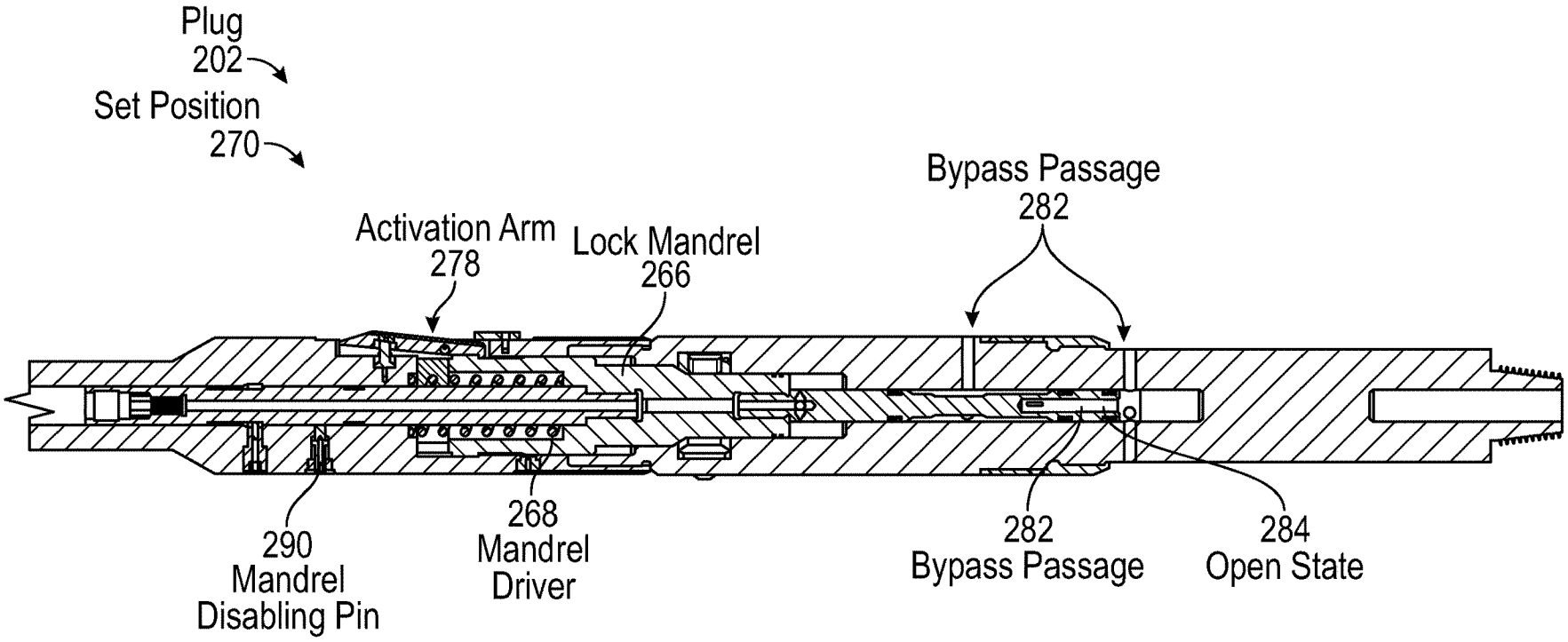

FIG. 7 shows the plug in accordance with one or more embodiments. In FIG. 7, the plug 202 is shown arranged in a configuration before being deployed (e.g., a set position 270). The plug has a dog mandrel (e.g., a lock mandrel 266) and a main spring (e.g., a mandrel driver 268). The main spring is configured to provide a motive force to move the mandrel. The spring is shown in a compressed condition (a compressed spring) such that the spring is exerting a spring force between the plug and the mandrel. The spring force is directed downward (e.g., downhole) with respect to the plug and may move the mandrel in the downhole direction. The arm (e.g., the activation arm 278) is shown connected with a hinge to the plug and the arm is latched onto the mandrel to hold the mandrel in place against the force of the compressed spring. The mandrel disabling pin (e.g., pin 290) is shown located on the plug.

Continuing with FIG. 7, a means for providing a motive force is illustrated. In accordance with one or more embodiments, the means for providing the motive force (e.g., spring force from, for example, the mandrel driver 268) may include one or more springs, metallic springs, gas-charged springs, motors, linear actuators, electro-magnets, solenoids, hydraulic cylinders, gears, or jack screws and/or latches, locks, or braking mechanisms. Electrically-operated means for providing the motive force may be powered by a battery or batteries, or by an external power source, electrically coupled to the electrically-operated means. Moving the mandrel may be initiated by a deploy command to move the mandrel sent from a control system and obtained by the system 200. Those skilled in the art will readily appreciate that the means for coupling and the means for moving the various elements combining fasteners, bearings, and actuators may be configured without departing from the scope of this disclosure. The means of providing the motive force may include one or more of, and in any combination in compression or in tension, a coil spring, a constant tension spring, a torsion spring, a gas-charged cylinder spring. The main spring (e.g., mandrel driver 268) may be a coil spring.

FIG. 7 also shows the path of the bypass passage 282. Specifically, the bypass passage 282 is shown in a configuration that allows hydraulic fluid to communicate along the length of the bypass (e.g., in an open state 284).

Figure 8:
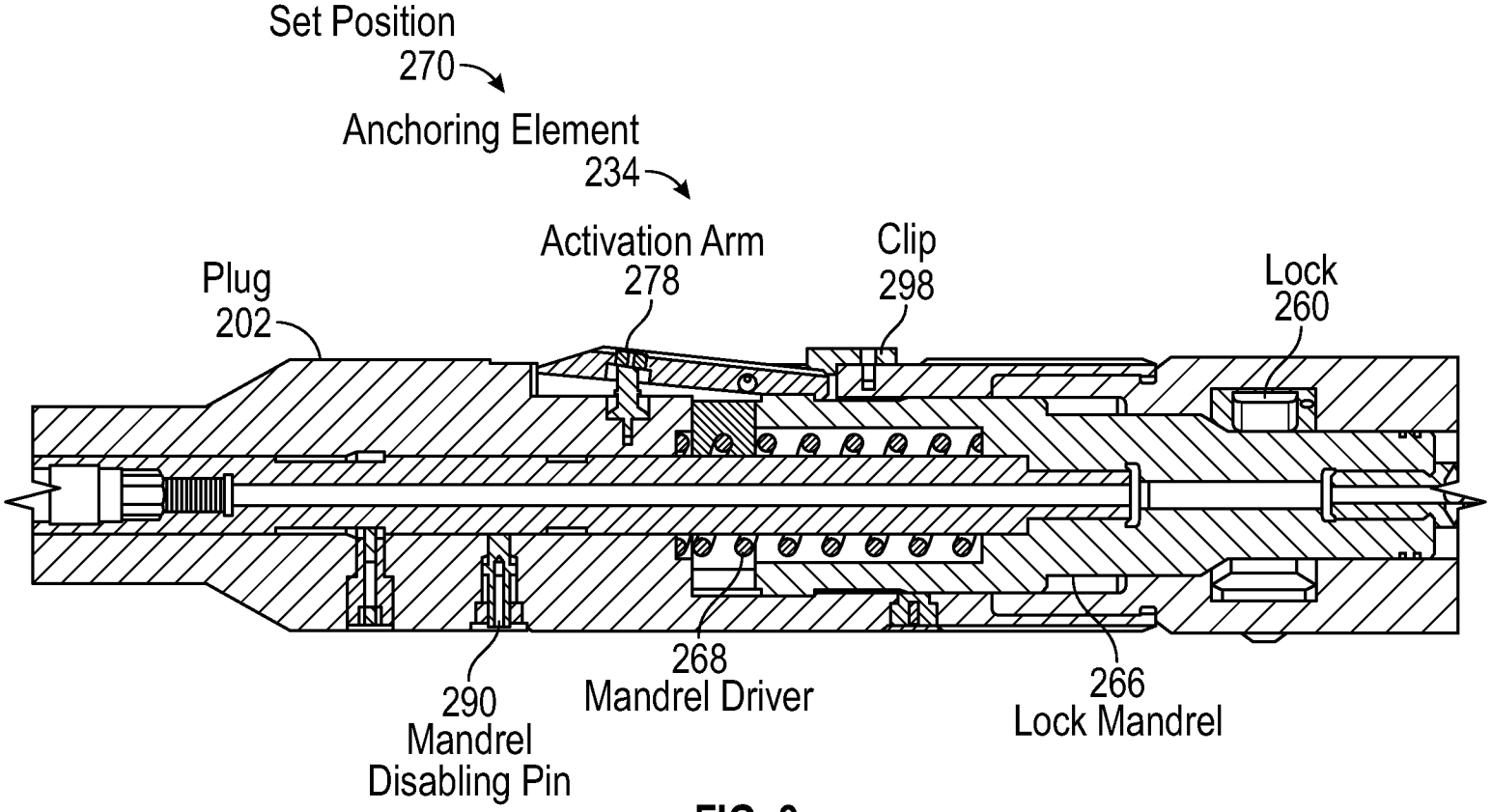

FIG. 8 shows the plug in accordance with one or more embodiments. The plug 202 is shown in the set position 270 with immobilizing elements (e.g., a clip 298). The clips hold the activation arms against the mandrel. Prior to deploying the plug, the clips are removed. The dogs (e.g., the lock 260) of the anchor (e.g., the anchoring element 234) are shown in the plug. In accordance with one or more embodiments the plug may have more than one of the locking dogs (lock 260.) For example, the plug may have six locking dogs (e.g., lock 260.) The main spring is shown compressed such that the spring is exerting a spring force between the plug and the mandrel. The arm is latched onto the mandrel to hold the mandrel in place against the force of the compressed spring. The mandrel disabling pin (e.g., pin 290) is shown located on the plug.

Figure 9:
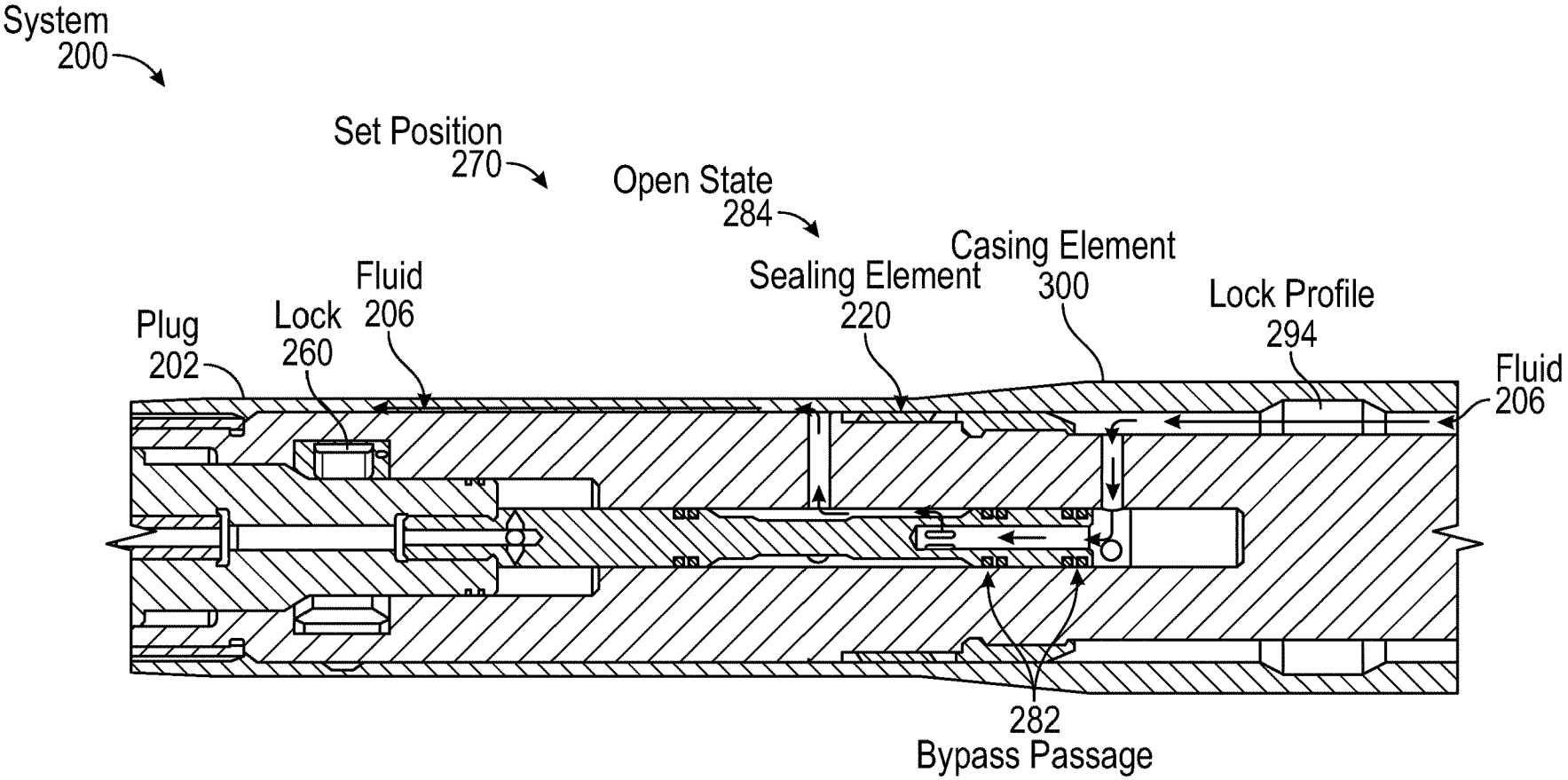
FIGS. 9-18 show a system with a plug in various stages and configurations in accordance with one or more embodiments.

FIG. 9 shows the system 200 of FIGS. 2A-2C in accordance with one or more embodiments. The plug 202 is shown with the lock 260. The lock profile 294 of the casing element 300 is shown downhole from the lock. The bypass passage 282 is shown in a configuration that allows hydraulic fluid to communicate along the length of the bypass passage (e.g., an open state 284). The seal (e.g., sealing element 220) is shown in relatively close proximity to the casing element thereby providing a relatively small gap, e.g., a tight fit, between the seal and the casing element. The small gap allows fluid to bypass the seal. For example, during running in hole (RIH, e.g., deploying the plug) or pulling out of hole (POOH, e.g., retrieving the plug) a displaced fluid may bypass the seal on the plug. For example, as the plug displaces fluid a differential pressure of the displaced fluid may build up below the seal during RIH or above the seal during POOH thereby forming a displaced fluid differential pressure bypassing the seal on the plug. The displaced fluid differential pressure bypassing the plug may travel past the seal outside surface 226. The displaced fluid differential pressure between a reservoir pressure downhole from the seal (i.e., below the seal) and a wellbore pressure that is uphole from the seal (i.e., above the seal) may pose a risk of problems with the well drilling operations such as surging the well and/or creating a possible issue with losing mud to the formation. Losing mud to the formation may be referred to as mud loss. More than one mud loss may be referred to generally as losses. The displaced fluid differential pressure developed by surging may be referred to as a surge pressure. As a mitigation against the risk, fluid displaced by the seal may also bypass the seal through the bypass passage 282 as indicated by the arrows.

Figure 10:
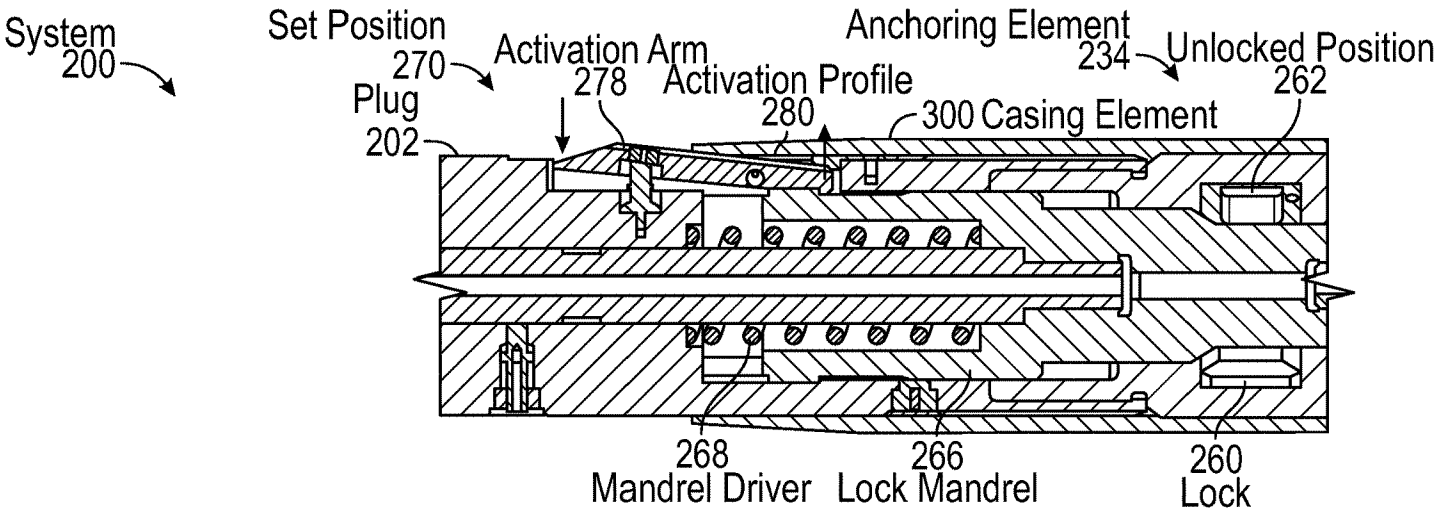

FIG. 10 shows the system 200 with the plug 202 entering the casing element 300 in the wellbore in accordance with one or more embodiments. The plug 202 of system 200 is shown in the set position 270. The anchoring element 234 components are shown. The locking dogs (e.g., lock 260) are shown in a recessed position (e.g., unlocked position 262.) The lock mandrel 266 is shown latched to the activation arm 278. The mandrel driver 268 is shown in the compressed spring state. An activation profile 280 is shown disposed on the casing string.

In FIG. 10, the profile (e.g., activation profile 280) is configured to cooperate with the arms (e.g., activation arm 278) such that the arms may not activate the mandrel (e.g., lock mandrel 266) by contacting profiles other than the activation profile. For example, the activation profile may be a correct internal diameter (ID) such as a correct casing ID to provide the necessary actuation configuration.

Still referring to FIG. 10, the activation arm 278 is in contact with the activation profile 280 and the mandrel in the set position 270 latched to the arm. As the plug travels downhole and contacts the activation profile 280, the activation arm 278 may be depressed, thereby moving inward toward the plug outer surface, rotating about the arm hinge, thereby unlatching, i.e., activating the mandrel.

FIG. 10 shows that, in accordance with one or more embodiments, there may be more than one of the activation arm 278. For example, the plug may be configured with three activation arms. Furthermore, the mandrel may not activate unless one, some, or all of the activation arms disengage the mandrel. There may be more than one activation profile and there may be unique associations with arms and profiles such that one of a set of arms is activated by one of a set of profiles. In this manner each arm may have a unique activation profile. Furthermore, one arm may be activated by more than one of a set of profiles. For example, one of three arms may be activated by two of three profiles. Likewise, one profile may activate more than one arm. For example, a profile may activate two of three arms.

Figure 11:
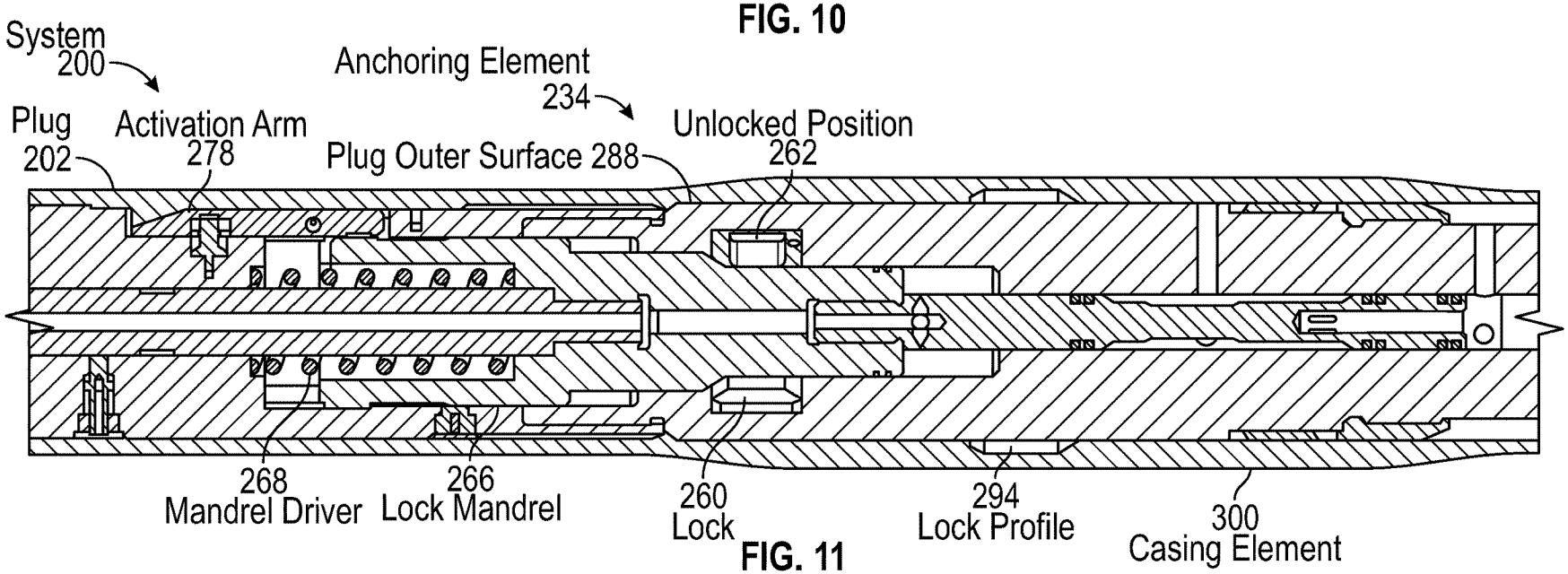

FIG. 11 shows the system 200 of FIG. 10 with anchoring element 234 components in accordance with one or more embodiments disclosed herein. In FIG. 11, the plug 202 is shown with the activation arms (e.g., activation arm 278) depressed thereby moved inward toward and substantially flush with the plug outer surface 288. The locking dogs (e.g., lock 260) are shown in a recessed position (e.g., unlocked position 262.) The lock mandrel 266 is shown unlatched from the activation arm 278. The mandrel driver 268 is shown in the compressed spring state. The mandrel driver 268 is moving the lock mandrel 266 in the direction of the arrow toward the lock 260. A lock profile 294 is shown disposed on the casing element 300.

Figure 12:
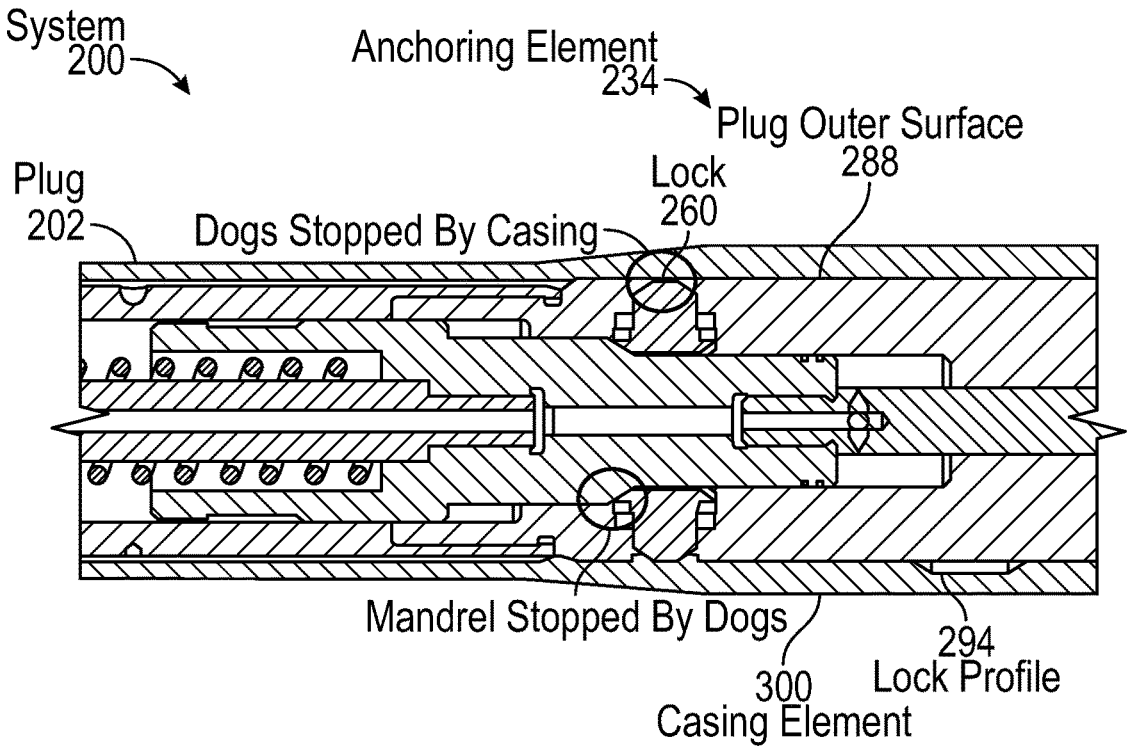

FIG. 12 shows the system 200 of FIG. 11 in accordance with one or more embodiments. In FIG. 12, the locking dogs (e.g., lock 260) are shown in a recessed position (e.g., unlocked position 262). A lock profile 294 is shown disposed on the casing element 300. The lock mandrel 266 is shown contacting the lock 260. The lock mandrel 266 and the lock 260 are configured to cooperate to extend the lock 260 out away from the plug outer surface 288 as the mandrel driver 268 pushes the lock mandrel 266 against the lock 260. For example, the mandrel may comprise a taper configured to cooperate with a corresponding taper on the locking dogs. As the mandrel moves against the dogs, the corresponding taper cause the dogs to extend.

FIG. 12 illustrates that the lock 260 is contacting the casing element 300 in a location that is not the lock profile 294, therefore the lock 260 is prevented from extending away from the plug outer surface 288, thus in turn preventing the lock mandrel 266 from moving under the motive force of the mandrel driver 268. FIG. 12 thus shows that the dogs (e.g. lock 260) are stopped by the casing (e.g., casing element 300) and the mandrel (e.g., lock mandrel 266) is stopped by the dogs. The plug may travel further along the casing, thus the dogs are shown riding on the ID of the casing. In this manner, the bypass passage 282 (FIG. 9) remains in the open state 284 (FIG. 9). FIG. 12 shows that the dog mandrel is prevented by the casing ID from being driven downwards by the main spring to its fully-stroked position.

Figure 13:
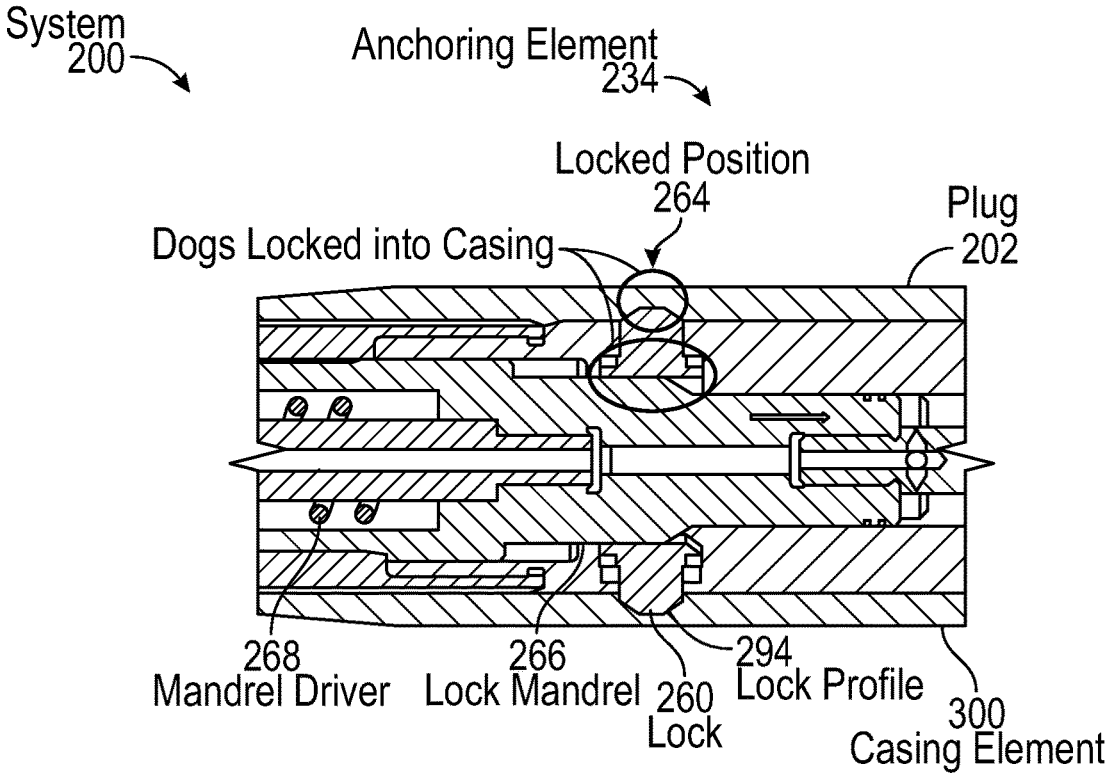

FIG. 13 shows the system 200 in accordance with one or more embodiments. In FIG. 13, the plug 202 is shown having traveled further downhole within the casing until the dogs reached the lock profile 294. Upon or soon after reaching the lock profile 294, the mandrel driver 268 moves the lock mandrel 266. The taper on the lock mandrel 266 cooperates with the taper on the lock 260 to extend the lock 260. The locking dogs (e.g., lock 260) are shown in an extended position (e.g., locked position 264) within the lock profile 294 disposed on the casing element 300. The lock mandrel 266 is shown having moved using the motive force from the mandrel driver 268. The lock mandrel 266 is shown having extended the lock 260 out away from the plug outer surface 288. For example, after the dogs reach the radial groove, the dog mandrel is released and is driven downwards by the main spring. After the dogs are fully out, the dog mandrel is able to fully stroke down the tool thereby locking the dogs in place. Furthermore, the lock mandrel 266 is shown having moved behind the lock 260 thereby securing the lock 260 in the locked position 264 and preventing the dogs from retracting back into the tool body.

Figure 14:
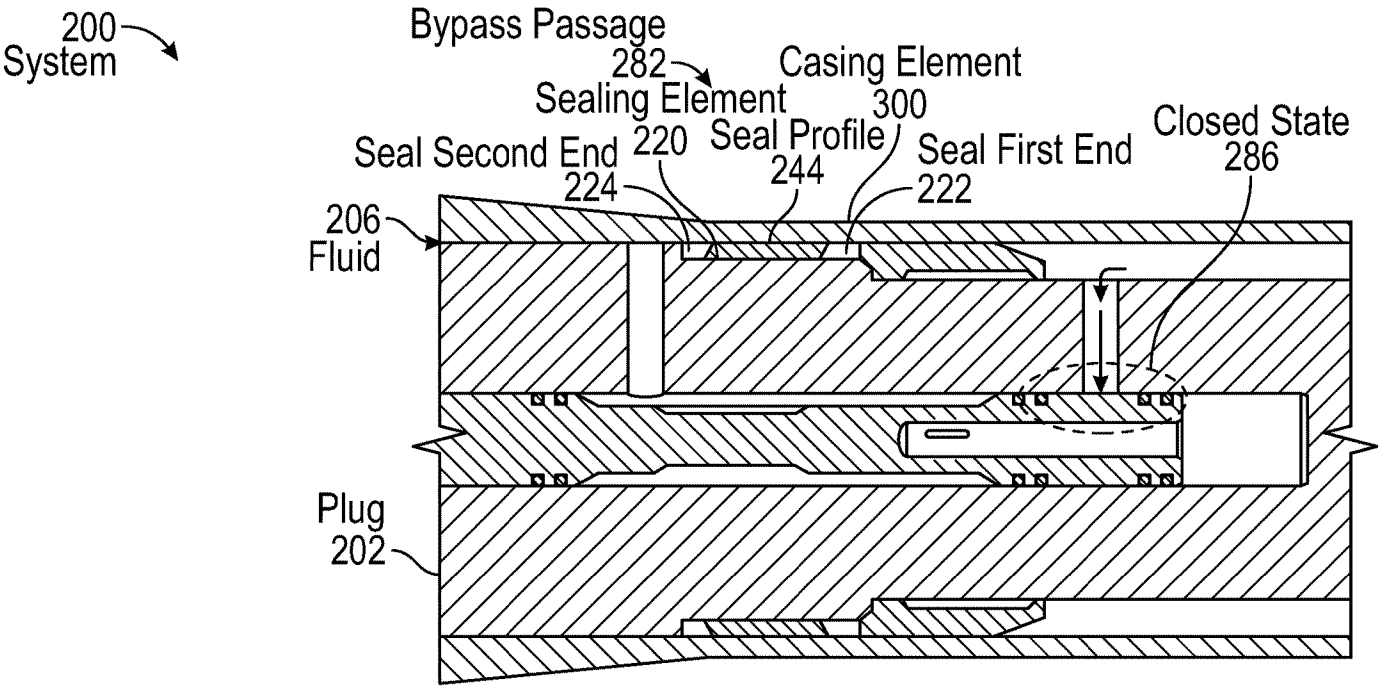

FIG. 14 shows the system 200 in accordance with one or more embodiments. In FIG. 14, the sealing element 220 is shown in contact with a seal profile 244. The seal profile 244 is disposed in the casing element 300. The sealing element 220 and the seal profile 244 cooperate to seal downhole pressure from below the plug 202. Specifically, the sealing element 220 may prevent pressure communication across sealing element 220 from the seal first end 222 to the seal second end 224. The fluid 206 may contact the sealing element 220. The sealing element 220 may comprise a swellable material which may swell upon or after contact with fluid 206. Swelling of the sealing element 220 may facilitate, augment, or improve the sealing capability of the sealing element 220. FIG. 14 also shows that the mandrel changes the state of the bypass passage 282 to the closed state 286 as indicated by the arrow. For example, the mandrel may close the bypass passage 282 when or soon after the lock 260 moves to the locked position 264. For another example, the mandrel may close the bypass passage 282 when or soon after the mandrel secures the lock 260.

Figure 15:
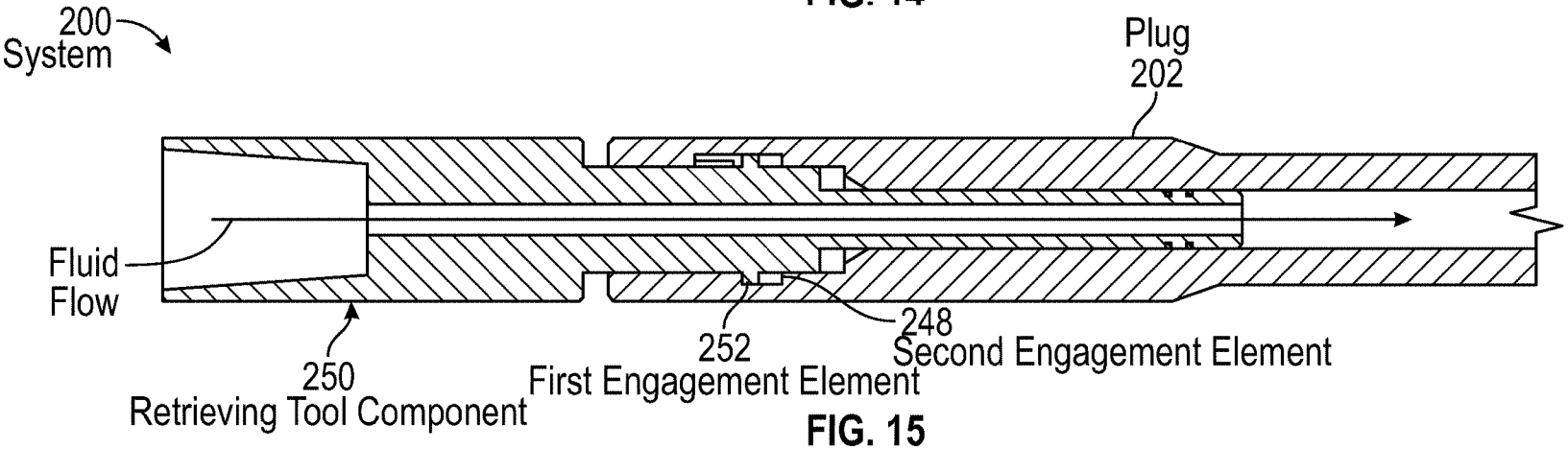

FIG. 15 shows the system 200 in accordance with one or more embodiments. The retrieving tool 250 is shown engaged with the plug 202. A first engagement element 252 on the retrieving tool 250 is configured to cooperate with a second engagement element 248 on the plug 202. The retrieving tool 250 is configured to couple to the downhole end of the drill string (e.g., second drill string 210 shown in FIG. 2A). The drill string (e.g., the second drill string 210) is shown coupled to the retrieving tool 250. The retrieving tool 250 is coupled to the plug 202.

For example, the retrieving tool 250 may use the first engagement element 252 to couple to the second engagement element 248 of the plug. In this manner the drill string 120 is coupled to the plug 202 using the second drill string 210 and the retrieving tool 250. Coupling the retrieving tool 250 to the plug 202 comprises both mechanical, load-bearing coupling, and hydraulic pressure communication and sealing coupling. Hydraulic pressure conveyed through the drill string is thus conveyed to the retrieving tool 250. Retrieving tool 250 comprises a conduit, such as a tube, for hydraulic communication and pressure sealing into the plug 202. The retrieving tool 250 is configured to form a fluid-tight seal between the drill string and the plug 202.

Figure 16:
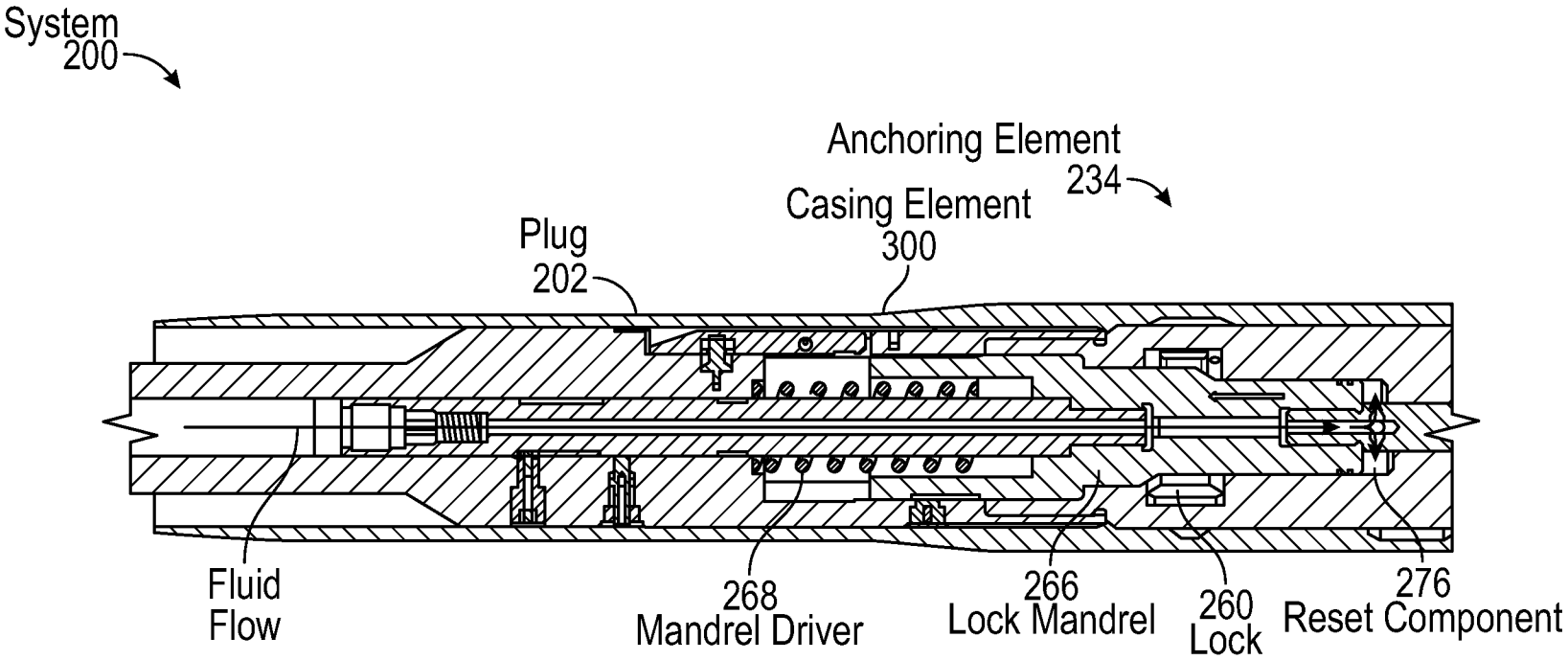

FIG. 16 shows the system 200 in accordance with one or more embodiments. A hydraulic pressure is shown conveyed through the plug 202. The pressure flows through the lock mandrel 266 to provide hydraulic pressure to a reset component 276. The reset component 276 is configured to move the lock mandrel 266 uphole against the motive force provided by the mandrel driver 268. Moving the lock mandrel 266 uphole may result in, for example, the mandrel driver 268 being compressed. In this manner a hydraulic pressure conveyed to the reset component 276 may move the lock mandrel 266 uphole and out from behind the dogs (e.g., lock 260). For example, internal string pressure provided by the drilling rig 138 (FIG. 1) through the drill string 120 (FIG. 1) and conveyed, using the retrieving tool 250, to the reset component 276 of the plug 202 may be used to unlock the plug 202.

Figure 17:
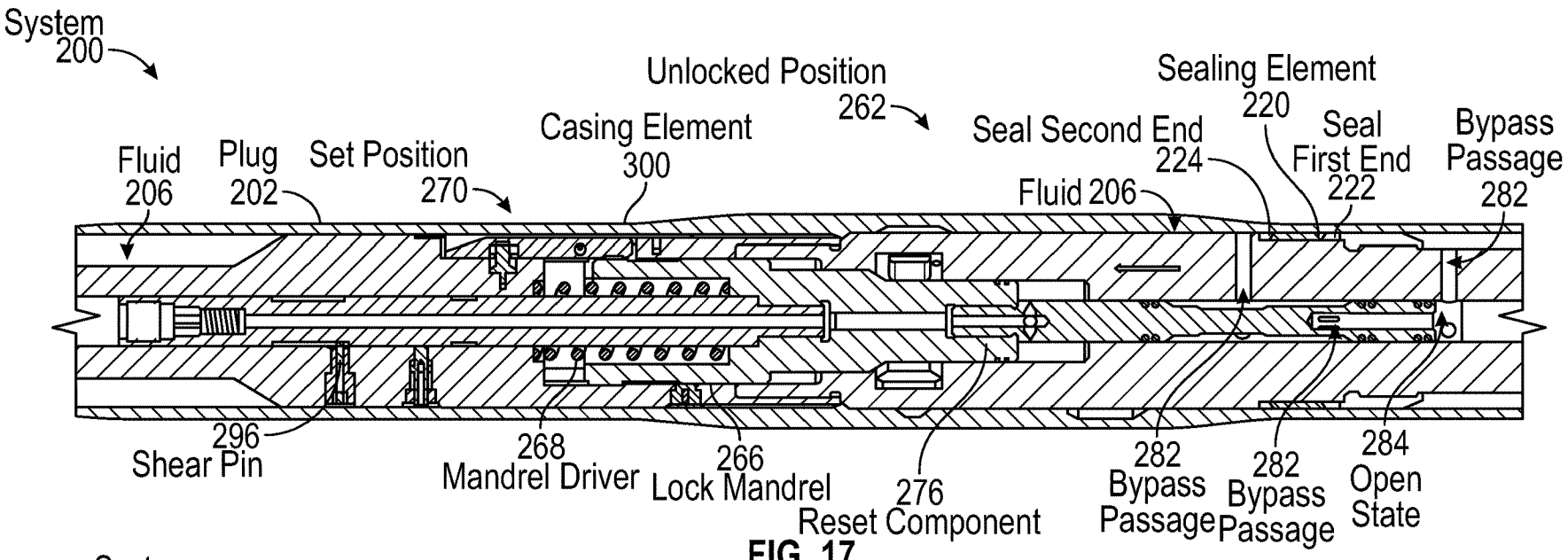

FIG. 17 shows the system 200 in accordance with one or more embodiments. Hydraulic pressure such as internal string pressure provided to the reset component 276 has retracted the mandrel, e.g., moved the lock mandrel 266 uphole, thereby compressing the mandrel driver 268. The lock mandrel 266 has moved out from behind the dogs (e.g., lock 260) thereby releasing them to shift to the unlocked position 262. The mandrel uphole travel may be limited in range by a reset stop (e.g., shear pin 296). The mandrel driver 268, the reset component 276, and a first reset pressure may be configured to stop the lock mandrel 266 at the set position 270. The lock mandrel 266, the mandrel driver 268, the lock 260, the lock profile 294 and the reset component 276 are configured such that reducing the pressure on the reset component 276 down from the first reset pressure may move the lock mandrel 266 back down thereby extending the lock 260 to the locked position 264 and the bypass passage 282 to the closed state 286.

Specifically, FIG. 17 shows that retracting the mandrel changes the bypass passage 282 to the open state 284. The open state 284 may allow any pressure built up below the sealing element 220 (e.g., pressure at the seal first end 222) to equalize with pressure above the sealing element 220 (e.g., pressure at the seal second end 224). Pressure equalization of the pressure differential across the sealing element 220 may be included in the well drilling operations as an activity to perform before pulling the plug 202 out of the casing element 300. The bypass passage 282 is configured to convey fluid 206 pumped into the wellbore outside of the plug outer surface 288. For example, the bypass passage 282 may convey fluid pumped into the annulus from the seal second end 224 above the sealing element 220 to the seal first end 222 below the sealing element 220.

Figure 18:
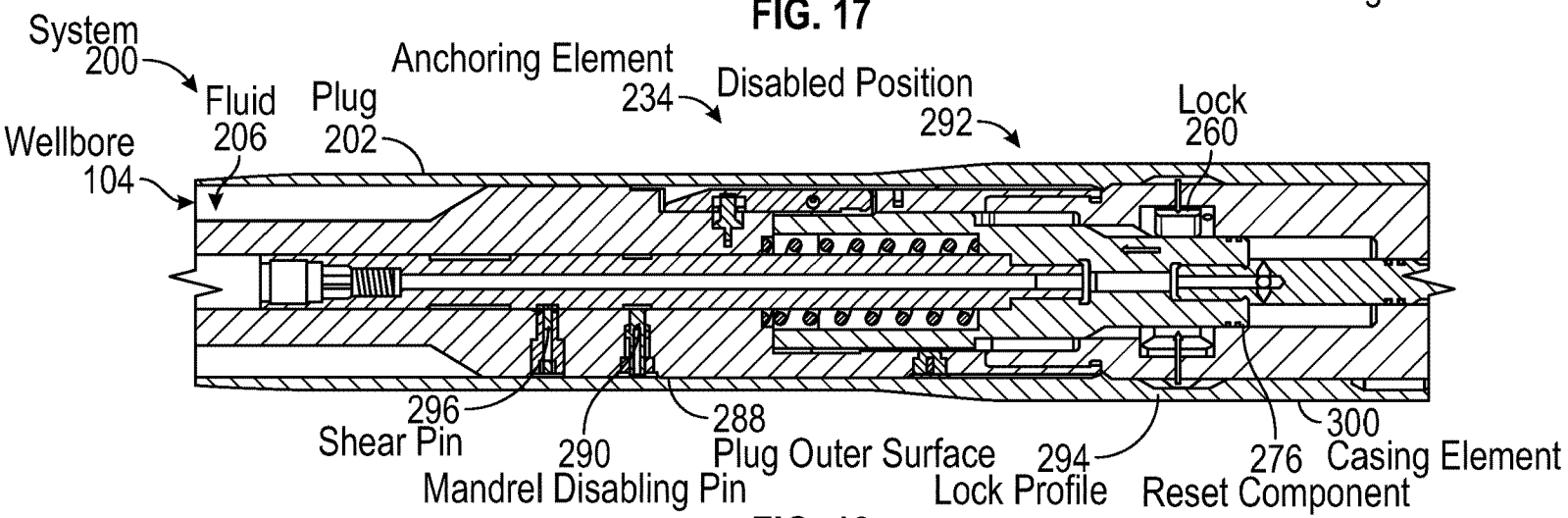

FIG. 18 shows the system 200 in accordance with one or more embodiments. Pressure equalization across the sealing element 220 may be included in the well drilling operations. Pressure equalized across the seal may prepare the plug 202 for removal from the casing element 300. The reset component 276 is configured to reset the anchoring element to a disabled position 292 using a second reset pressure. Hydraulic pressure such as the internal string pressure acting on the reset component 276 may be increased to the second reset pressure predetermined to shear the shear pin. The sheared shear pin in coordination with the second reset pressure thereby allows the lock mandrel 266 to move further uphole from the set position 270 (FIG. 17) to a disabled position 292.

Specifically, FIG. 18 shows that at the disabled position 292 a mandrel disabling pin (e.g., the pin 290) coupled to the plug 202 engages the anchoring element 234 thereby holding the anchoring element 234 in the disabled position 292 against the motive force of the main spring. (e.g., mandrel driver 268). The lock mandrel 266 retracts further uphole and the dogs (e.g., lock 260) collapse into the tool body (away from plug outer surface 288.) FIG. 18 shows the lock open pin (e.g., pin 290) deploys into the mandrel to stop the mandrel from activating again when the internal pressure is removed. The tool can now be pulled from the wellbore. The drilling rig 138 pulls the drill string, the retrieving tool, and the plug from the wellbore. At the surface 122 the first engagement element 252 of the retrieving tool 250 is decoupled from the second engagement element 248 of the plug 202. At this point the operator may restart well drilling operations.

While FIGS. 1, 2A, 2B, 2C, and 3-18 show various configurations of hardware components and/or software components, other configurations may be used without departing from the scope of the disclosure. For example, various components in FIGS. 1, 2A, 2B, 2C, and 3-18 may be combined to create a single component. As another example, the functionality performed by a single component may be performed by two or more components.

Figure 19:
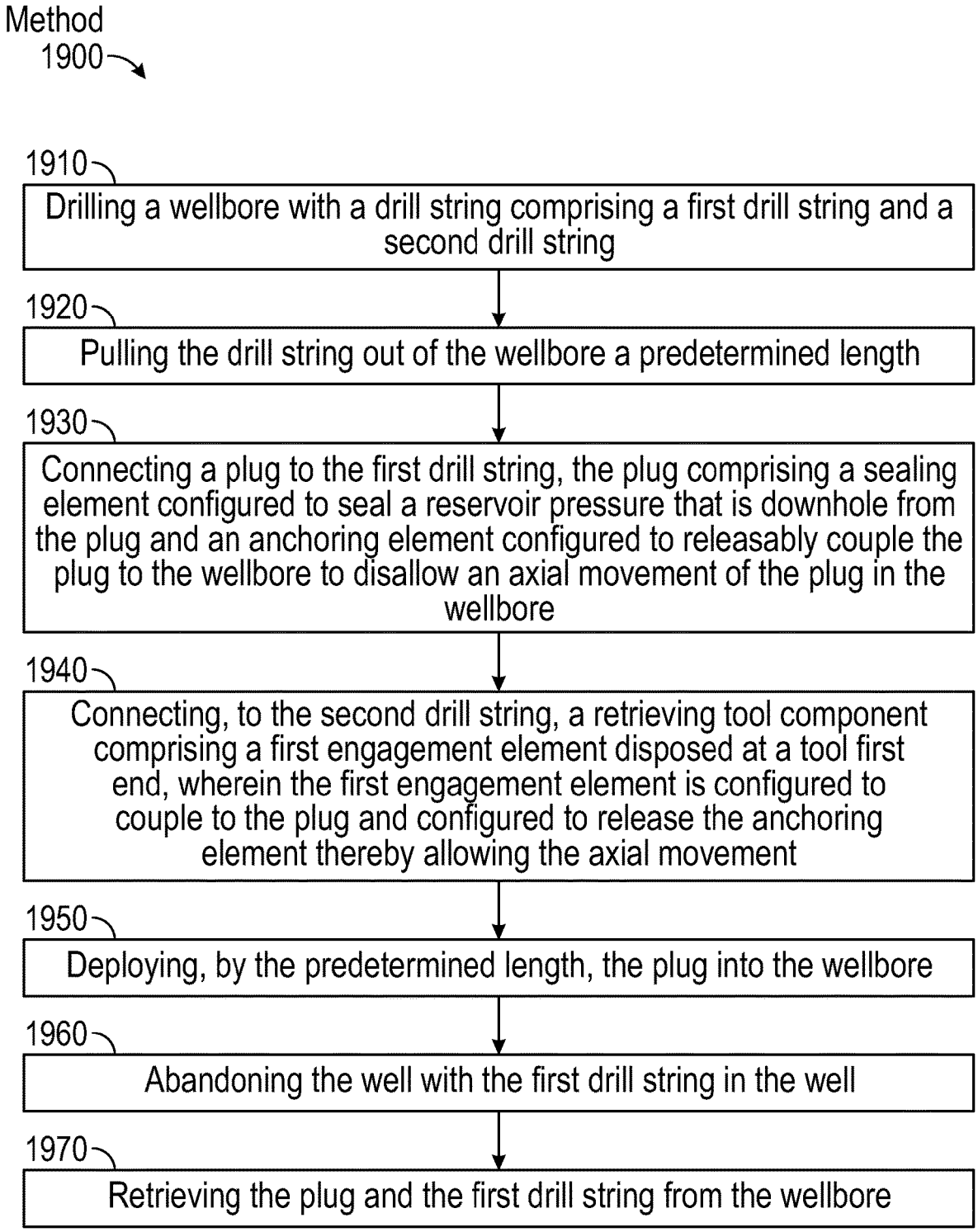
FIG. 19 shows a flowchart for a method in accordance with one or more embodiments.

FIG. 19 shows a flowchart for a method 1900 in accordance with one or more embodiments. Specifically, FIG. 19 describes method for temporarily abandoning a first portion of a drill string in a wellbore by installing a packer, suspending the first portion of the drill string below the packer, and retrieving a second portion of the drill string. One or more blocks in FIG. 19 may be performed using one or more components as described in FIGS. 1, 2A, 2B. 2C, and 3-18. While the various blocks in FIG. 19 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially, at step 1910, the method involves drilling a wellbore with a drill string. For example, the drill string may include a first drill string and a second drill string coupled to a bottom hole assembly (BHA) with a drill bit used for drilling into a formation. The drill string may be rotated and conveyed by a drilling rig. The drill string may enter the wellbore through a blowout preventer (BOP.) A fluid such as a wellbore fluid may be used for drilling the wellbore. The wellbore drilling may include installing casing in the wellbore. A special joint of casing (e.g., a casing element) with an activation profile, a seal profile, and/or a lock profile may be installed in the wellbore. The activation profile, the seal profile, and/or the lock profile (the profiles) may be disposed in the casing element at predetermined profile positions within the casing element. For example, the activation profile may be disposed at a predetermined activation profile depth, the seal profile may be disposed at a predetermined seal profile depth, and/or the lock profile may be disposed at a predetermined lock profile depth. The casing element may be installed into the well as part of the last casing run and the depth at which the casing element is installed may be at a predetermined depth. The predetermined profile positions and the predetermined depth provide a known location of the profiles with respect to a datum such as the surface or the rig floor. Installation of the casing element may be included in the well drilling operations and the production casing operations.

At step 1920, the drill string is pulled out of the wellbore a predetermined length. The drill string should be tripped to a position in the well where it can be safely left for a period of time. For example the drill string may be tripped to a depth inside the last casing shoe. A length of drill pipe exceeding the depth of the special receiving casing joint (e.g., the casing element) may also be removed from the well. For example, the length of drill pipe to be removed may be 100-300 ft. If the open hole 232 length to bottom hole 240 exceeds the example 100-300 ft, then the drill bit may be left in the open hole section. In accordance with one or more embodiments the drill bit may be pulled out of hole a length that exceeds the open hole section such that the drill bit is located within the casing, i.e., uphole of the lowest casing shoe. The drill bit may be pulled out of hole further uphole from the lowest casing shoe as a margin of safety to ensure the drill bit does not remain in the open hole section. In that case, the distance to pull out of hole is the distance from the casing shoe to the bottom of the hole, plus the depth of the special receiving casing, plus a margin for safety. A margin of safety may be determined by a quantity of stands such as one stand.

At step 1930, the drill string is separated into a downhole portion (e.g., the first drill string) and an uphole portion (e.g., the second drill string). The method includes connecting a plug (i.e., a wellbore isolation tool) to the uphole end of the first drill string. The plug may have a sealing element configured to seal a reservoir pressure that is downhole from the plug. The sealing element may cooperate with the seal profile to seal the reservoir pressure. The plug may include an anchoring element configured to releasably couple the plug to the wellbore to disallow an axial movement of the plug in the wellbore. The anchoring element may include locking dogs (e.g., a lock) that cooperate with the lock profile to disallow the axial movement. The anchoring element may include activation arms configured to cooperate with the activation element to extend the lock into the lock profile and secure the lock in the lock profile.

At step 1940, the plug coupled to the first drill string is lowered into the well and pipe slips are set on the plug at the rig floor, e.g., on a tool upper body. The pipe slips are coupled to rig floor and configured to cooperate with the plug to suspend the plug and the first drill string from the rig floor. The method includes picking up a stand of drill pipe (e.g., the second drill string) from the derrick and connecting a retrieving tool component (e.g., a retrieving tool) to the downhole end of the second drill string. The retrieving tool component has a first engagement element disposed at the downhole end of the retrieving tool (e.g. a tool first end.) The first engagement element is configured to couple to the plug at a J-slot (e.g., a second engagement element) disposed in the plug. The first engagement element is configured to release the anchoring element thereby allowing the axial movement. The method may include coupling the retrieving tool component to the plug by coupling the first engagement element to the second engagement element disposed in the plug.

At step 1950, the method includes deploying the plug into the wellbore by the predetermined length. Specifically. Step 1950 may include picking up the second drill string to expose the immobilizing element (e.g., the clip or clips) mounted on the plug and removing the immobilizing element from the plug. Removing the immobilizing element allows the activation arms to move, which will release the anchoring element once inside casing and traveling past the activation profile.

At this stage, the well is abandoned with the first drill string in the well (Step 1960). The plug may be run in hole (RIH) slowly. The sealing element on the plug is designed to be a tight fit on the internal casing bore to create a good seal. The sealing may be augmented with a fast-swelling elastomer energizing element such as a swellable material. As the tool travels in the wellbore in the presence of a fluid in the wellbore, a pressure differential (e.g., a first pressure differential) may form across the sealing element as fluid from one side of the seal (e.g., a seal first end) flows to the second side of the seal (e.g., a seal second end). This first pressure differential may create problems with the well construction. Problems may include surging or causing loss of mud to the formation. To avoid surging the well and/or creating issues with losses, the tool is fitted with a seal bypass passage which allows a pressure equalization across the seal when the tool is being run in or pulled out of hole. The pressure equalization may relieve a surge pressure. The method may include equalizing the first differential pressure.

The method for abandoning the well may include anchoring the plug in the wellbore using the anchoring element. Anchoring the plug may include extending the locking dogs (e.g., the lock, coupled to the plug) into the lock profile. The lock may be extended from an unlocked position to a locked position within the lock profile using a lock mandrel and a mandrel driver.

The method for deploying the plug may include lowering the plug into an activation profile configured to cooperate with an activation arm. The activation arm may retain the anchoring element in a set position and cooperate with the anchoring element to activate the anchoring element. The method may include activating the anchoring element, lowering the plug the predetermined length, and securing the anchoring element. The method may include closing the bypass passage and sealing the reservoir pressure below the plug. The seal may comprise a swellable material that may swell to contact the seal profile disposed in the wellbore. Abandoning the well may include suspending the first drill string below the plug.

The method may continue with checking to ensure the tool is engaged. Confirming engagement may include, for example, slacking off and pulling up on the drill string and observing the weight and overpull. Upon successful installation, the J-slot running tool can now be released from the isolation tool and the string removed from the wellbore. Abandoning the well includes disengaging the first engagement element on a running tool component (e.g., the retrieving tool) from the J-slot in the plug and pulling the second drill string out of the wellbore. The BOPs can now be closed over the well.

At step 1970, the method includes retrieving the plug and the first drill string from the wellbore. Recovering the tool from the wellbore may include, for example, opening the BOPs and running the J-slot tool in hole on drill pipe and engaging with the top of the tool. Retrieving the plug may include deploying the second drill string and the retrieving tool component into the wellbore, coupling the first engagement element to the plug, and retrieving the second drill string, the plug, and the first drill string out of the wellbore by the predetermined length. The J-slot tool engages the upper body of the plug or the wellbore isolation tool. The method may include pulling up to confirm engagement of the J-slot tool with the isolation tool and to maintain tension on the isolation tool. A pressure may be provided through the drill string and the retrieving tool element to the plug. For example, rig pumps may provide the pressuring of the drill string. The pressuring of the plug may create a piston force on the bottom of the dog mandrel (e.g., the reset component) thereby driving the mandrel up to compress the main spring. Next the method may include decoupling the first engagement element from the plug, decoupling the second drill string from the retrieving tool component, connecting the second drill string to the first drill string, and restarting drilling.

The method may include pressurizing a reset component in hydraulic communication with the second drill string to a first reset pressure thereby allowing the axial movement of the plug in the wellbore. The method may continue by equalizing, using the reset component, a second pressure differential between the reservoir pressure and a wellbore pressure that is uphole. The method may include pressurizing the reset component to a second reset pressure to disable the plug, and then applying uphole tension on the second drill string to retrieve the plug.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A plug system comprising:

a body comprising two ends, a first end being connected to a lower drill string and a second end connected to an upper drill string, the body further comprising:

a sealing element configured to seal against a reservoir pressure that is downhole from the plug system;

an anchoring element configured to releasably couple the plug system to a wellbore to disallow an axial movement of the plug system in the wellbore; and a mandrel disabling pin coupled to a plug outer surface; wherein the mandrel disabling pin is configured to hold the anchoring element to the plug outer surface thereby disabling the anchoring element, wherein the plug system is configured to couple to a retrieving tool, the retrieving tool comprising a first engagement element configured to release the anchoring element, thereby allowing the axial movement of the plug system and retrieval of the upper drill string in order to shut in the wellbore.

2. The plug system of claim 1, wherein the plug system further comprises a seal bypass passage configured to allow a surge pressure to bypass the sealing element.

3. The plug system of claim 1, wherein the anchoring element comprises a lock selectively extendible between an unlocked position and a locked position.

4. The plug system of claim 1, wherein the plug system comprises an activation arm and a lock mandrel to activate the anchoring element.

5. The plug system of claim 1, wherein:

the sealing element is configured to cooperate with the wellbore to seal the reservoir pressure, wherein the sealing element comprises a material which swells upon contact with a fluid.

6. The plug system of claim 1, wherein the plug system further comprises a bypass passage selectively operable between an open state and a closed state.

7. The plug system of claim 1, further comprising:

a reset component in hydraulic communication with the upper drill string, wherein the reset component resets the anchoring element to a set position using a first reset pressure, and the reset component places the anchoring element in a disabled position using a second reset pressure.

8. The plug system of claim 1, further comprising:

a casing element comprising a lock profile disposed in the wellbore at a predetermined depth, wherein the anchoring element is configured to cooperate with the lock profile to disallow the axial movement.

9. The plug system of claim 1, further comprising:

a casing element comprising an activation profile disposed in the wellbore at a predetermined activation profile depth, and wherein the anchoring element is configured to cooperate with the activation profile to activate the anchoring element.

10. The plug system of claim 1, further comprising:

a casing element comprising a seal profile disposed in the wellbore at a predetermined seal profile depth, wherein the sealing element is configured to cooperate with the seal profile to seal the reservoir pressure.

11. A method for abandoning a well, the method comprising:

drilling a wellbore with a drill string comprising a lower drill string and an upper drill string;

pulling the drill string out of the wellbore a predetermined length;

connecting a plug system to the lower drill string, the plug system comprising:

a body comprising two ends, a first end being connected to the lower drill string and a second end connected to the upper drill string, the body further comprising:

a sealing element configured to seal a reservoir pressure that is downhole from the plug system;

an anchoring element configured to releasably couple the plug system to the wellbore to disallow an axial movement of the plug system in the wellbore; and a mandrel disabling pin coupled to a plug outer surface; wherein the mandrel disabling pin is configured to hold the anchoring element to the plug outer surface thereby disabling the anchoring element, connecting, to the upper drill string, a retrieving tool comprising a first engagement element disposed at a tool first end, wherein the first engagement element is configured to couple to the plug system and configured to release the anchoring element thereby allowing the axial movement;

deploying the plug system into the wellbore;

anchoring the plug system in the wellbore using the anchoring element;

disengaging the first engagement element from the plug system;

pulling the upper drill string out of the wellbore; and abandoning the well with the lower drill string in the well.

12. The method of claim 11, further comprising:

coupling the first engagement element to a second engagement element disposed in the plug system.

13. The method of claim 11, wherein deploying the plug system into the wellbore further comprises:

displacing a fluid thereby forming a first pressure differential between a seal first end and a seal second end; and equalizing the first pressure differential using a seal bypass passage configured to allow a surge pressure to bypass the sealing element.

14. The method of claim 11, wherein:

the anchoring element comprises a lock selectively extendible between an unlocked position and a locked position, and abandoning the well further comprises extending, using a lock mandrel and a mandrel driver, the lock from the unlocked position to the locked position within a lock profile disposed in the wellbore.

15. The method of claim 11, wherein:

the body further comprises an activation arm and a lock mandrel to activate the anchoring element;

deploying the plug system into the wellbore further comprises:

lowering the plug system into an activation profile configured to cooperate with the activation arm wherein the activation arm is configured to:

retain the anchoring element in a set position, and cooperate with the anchoring element to activate the anchoring element;

activating the anchoring element;

lowering the plug system the predetermined length; and securing the anchoring element.

16. The method of claim 11, wherein:

the plug system further comprises a bypass passage selectively operable between an open state and a closed state, and abandoning the well further comprises closing the bypass passage.

17. The method of claim 11, wherein:

the sealing element is configured to cooperate with the wellbore to seal the reservoir pressure, wherein the sealing element comprises a material which swells upon contact with a fluid, and abandoning the well further comprises sealing the reservoir pressure by swelling the sealing element to contact a seal profile disposed in the wellbore.

18. The method of claim 11, further comprising suspending the lower drill string below the plug system.

19. The method of claim 11, wherein retrieving the plug system and the lower drill string comprises:

deploying the upper drill string and the retrieving tool into the wellbore;

coupling the first engagement element to the plug system;

retrieving the upper drill string, the plug system, and the lower drill string out of the wellbore by the predetermined length;

decoupling the first engagement element from the plug system;

decoupling the upper drill string from the retrieving tool;

connecting the upper drill string to the lower drill string; and restarting drilling.

20. The method of claim 11, further comprising:

pressurizing a reset component in hydraulic communication with the upper drill string to a first reset pressure;

resetting the anchoring element to a set position using the first reset pressure thereby allowing the axial movement, equalizing, using the reset component, a second pressure differential between the reservoir pressure and a wellbore pressure that is uphole of the sealing element, pressurizing the reset component to a second reset pressure, placing the anchoring element in a disabled position using the second reset pressure, disabling the plug system, and applying uphole tension on the upper drill string to retrieve the plug system.

* * * * *